US012371842B2

(12) United States Patent
Chun et al.

(10) Patent No.: US 12,371,842 B2
(45) Date of Patent: Jul. 29, 2025

(54) DETERGENT SUPPLY DEVICE AND WASHING MACHINE INCLUDING THE SAME

(71) Applicant: SAMSUNG ELECTRONICS CO., LTD., Suwon-si (KR)

(72) Inventors: Kwangmin Chun, Suwon-si (KR); Baekgyu Kwon, Suwon-si (KR); Byeongwoo Kim, Suwon-si (KR); Geonhui Jo, Suwon-si (KR); Doyun Lee, Suwon-si (KR); Youngchul Jo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 254 days.

(21) Appl. No.: 18/088,124

(22) Filed: Dec. 23, 2022

(65) Prior Publication Data

US 2023/0272571 A1 Aug. 31, 2023

Related U.S. Application Data

(63) Continuation of application No. PCT/KR2022/019945, filed on Dec. 8, 2022.

(30) Foreign Application Priority Data

Feb. 25, 2022 (KR) ..... 10-2022-0025532

(51) Int. Cl.
*D06F 39/02* (2006.01)
*D06F 23/02* (2006.01)
(Continued)

(52) U.S. Cl.
CPC ..... *D06F 39/022* (2013.01); *D06F 23/02* (2013.01); *D06F 34/14* (2020.02); *D06F 2103/00* (2020.02)

(58) Field of Classification Search
CPC ..... D06F 39/022
See application file for complete search history.

(56) References Cited

U.S. PATENT DOCUMENTS 7,913,522 B2 3/2011 Park
10,077,527 B2 9/2018 Back et al.
(Continued)

FOREIGN PATENT DOCUMENTS

CN 112359555 A 2/2021
EP 2 733 249 B1 11/2016
(Continued)

OTHER PUBLICATIONS

International Search Report dated Mar. 29, 2023 issued in PCT Application No. PCT/KR2022/019945.
(Continued)

*Primary Examiner* — Spencer E. Bell
(74) *Attorney, Agent, or Firm* — STAAS & HALSEY LLP

(57) ABSTRACT

A washing machine includes a cabinet, a drum inside the cabinet and having a washing chamber formed therein, and a detergent supply device configured to supply a detergent to the washing chamber, the detergent supply device including a detergent container having a detergent accommodation space formed therein to accommodate the detergent to be supplied; and a detergent pump detachably coupled to the detergent container, the detergent pump to pump a detergent accommodated in the detergent accommodation space, the detergent pump including a detecting member to detect an amount of the detergent accommodated in the detergent accommodation space, the detecting member extending forward to be inserted into the detergent accommodation space.

18 Claims, 21 Drawing Sheets

(51) Int. Cl.
*D06F 34/14* (2020.01)
*D06F 103/00* (2020.01)

(56) References Cited

U.S. PATENT DOCUMENTS

| | | | |
|---|---|---|---|
| 10,801,155 | B2 | 10/2020 | Kim et al. |
| 11,078,618 | B2 | 8/2021 | Jung et al. |
| 11,384,466 | B2 | 7/2022 | Jung et al. |
| 11,560,659 | B2 | 1/2023 | Chae et al. |
| 2020/0325613 | A1 | 10/2020 | Chae et al. |
| 2021/0062391 | A1 | 3/2021 | Jung et al. |
| 2021/0062395 | A1 | 3/2021 | Jung et al. |
| 2021/0172108 | A1 | 6/2021 | Choi et al. |

FOREIGN PATENT DOCUMENTS

| | | | |
|---|---|---|---|
| EP | 3 190 293 | A1 | 7/2017 |
| JP | 2008-154470 | A | 7/2008 |
| KR | 1995-0007066 | B1 | 6/1995 |
| KR | 10-2005-0091294 | | 9/2005 |
| KR | 10-2005-0108788 | A | 11/2005 |
| KR | 10-1394512 | B1 | 5/2014 |
| KR | 10-2018-0082782 | A | 7/2018 |
| KR | 10-1992137 | | 6/2019 |
| KR | 10-2020-0018541 | | 2/2020 |
| KR | 10-2020-0120200 | | 10/2020 |
| KR | 10-2020-0120203 | A | 10/2020 |
| KR | 10-2021-0026229 | A | 3/2021 |
| KR | 10-2021-0027018 | A | 3/2021 |
| KR | 10-2021-0027090 | A | 3/2021 |
| KR | 10-2021-0071559 | A | 6/2021 |
| KR | 10-2021-0087649 | A | 7/2021 |
| KR | 10-2021-0107603 | | 9/2021 |
| KR | 10-2628096 | | 1/2024 |

OTHER PUBLICATIONS

Written Opinion Report dated Mar. 29, 2023 issued in PCT Application No. PCT/KR2022/019945.
Supplementary European Search Report dated Nov. 21, 2024 issued in European Application No. EP 22 92 9088.

DETERGENT SUPPLY DEVICE AND WASHING MACHINE INCLUDING THE SAME

CROSS-REFERENCE TO RELATED APPLICATION

This application is a continuation application, under 35 U.S.C. § 111(a), of International Patent Application No. PCT/KR2022/019945, filed on Dec. 8, 2022, which claims the priority benefit under 35 U.S.C. § 119 to Korean Patent Application No. 10-2022-0025532, filed on Feb. 25, 2022 in the Korean Intellectual Property Office, the disclosure of which is incorporated herein by reference.

BACKGROUND

1. Field

Embodiments of the present disclosure relate to a washing machine, and more particularly, to a detergent supply device, which is provided to supply a detergent to a washing chamber of a washing machine, and a washing machine including the same.

2. Description of the Related Art

Generally, a washing machine is a device that spins laundry put into a washing chamber, washing water, and a detergent together using a driving force of a motor so that the laundry is washed by being rubbed against the washing water and detergent.

A detergent supply device is a device that allows a detergent to be evenly mixed with water and supplied together with the water in the process in which the water is supplied into a tub of the washing machine. In a case in which the detergent is a liquid detergent, the liquid detergent can be directly supplied into the tub.

The detergent supply device may include a detergent container configured to accommodate a detergent and a detergent pump configured to pump the detergent accommodated in the detergent container. The detergent accommodated in the detergent container may be suctioned into the detergent pump, discharged back to the outside of the detergent pump, and move to the washing chamber together with the washing water.

A detecting member configured to detect the amount of detergent accommodated in the detergent container may be provided. Since the detecting member can detect the amount of detergent only when in contact with the detergent, in a case in which the detecting member is coupled to the detergent pump, a method of bringing the detecting member into contact with the detergent may be a problem.

In addition, the detergent container in a state in which the detergent pump is not coupled thereto should not cause leakage of the detergent, and the detergent container in a state in which the detergent pump is coupled thereto should allow the detergent to flow out of the detergent container so that the detergent flows to the detergent pump. Accordingly, a method of allowing the detergent to flow out of the detergent container may be a problem.

SUMMARY

Therefore, it is an aspect of the present disclosure to provide a detergent supply device, which accurately recognizes the amount of detergent in a case in which a detergent supply device of a washing machine recognizes the amount of detergent inside a detergent container, and a washing machine including the same.

It is another aspect of the present disclosure to provide a detergent supply device, which prevents leakage of a detergent by a detergent container and a detergent pump of the detergent supply device being separated from each other, and a washing machine including the same.

Additional aspects of the disclosure will be set forth in part in the description which follows and, in part, will be obvious from the description, or may be learned by practice of the disclosure.

In accordance with one aspect of the present disclosure, a washing machine includes a cabinet, a drum inside the cabinet, the drum having a washing chamber formed therein, and a detergent supply device configured to supply a detergent to the washing chamber, the detergent supply device including a detergent container having a detergent accommodation space defined therein to accommodate the detergent to be supplied, and a detergent pump detachably coupled to the detergent container, to pump the detergent accommodated in the detergent accommodation space, the detergent pump including a detecting member to detect an amount of the detergent accommodated in the detergent accommodation space, the detecting member extending forward to be inserted into the detergent accommodation space.

The detergent pump may further include a detergent suctioner to suction the detergent accommodated in the detergent accommodation space into the detergent pump, and the detergent pump extends forward to be inserted into the detergent accommodation space.

The detergent container may have a plurality of detergent container holes defined in a rear side of the detergent container, and the plurality of detergent container holes may include a first detergent container hole defined to correspond to the detergent suctioner so that the detergent suctioner passes through the first detergent container hole and is accommodated in the detergent accommodation space and a second detergent container hole defined to be apart from the first detergent container hole and defined to correspond to the detecting member so that the detecting member passes through the second detergent container hole and is accommodated in the detergent accommodation space.

The detergent supply device may further include a detergent compartment valve module configured to control an inflow of the detergent from inside the detergent accommodation space into the detergent pump, and the detergent compartment valve module may include a valve case having a valve case hole defined therein to allow the detergent accommodated in the detergent accommodation space to flow into the valve case hole and a detergent compartment valve movable to a front of the detergent accommodation space and simultaneously open or close the first detergent container hole and the second detergent container hole to control an outflow of the detergent accommodated in the detergent accommodation space through the first detergent container hole and the second detergent container hole.

The detergent container further has a valve sealing recess defined therein and the detergent container corresponding to a shape of a rear side of the detergent compartment valve and configured to retreat rearward may be defined at positions at which the plurality of detergent container holes are defined, and the detergent compartment valve module may further include a valve sealing member coupled to correspond to a rear edge of the detergent compartment valve to seal between the detergent compartment valve and the valve sealing recess.

The detergent suctioner may be configured to press the detergent compartment valve forward so that sealing between the plurality of detergent container holes and the detergent compartment valve by the valve sealing member is released, and a detergent suction port defined to allow the detergent accommodated in the detergent accommodation space to flow into the detergent suctioner, the detergent suction port may be defined in a side of the detergent suctioner.

In response to the detergent compartment valve being pressed and moved, the detecting member may be positioned inside the detergent accommodation space.

The detergent pump may further include a first hole sealing member positioned to surround an outer side of the detergent suctioner and configured to seal the first detergent container hole so that the detergent is prevented from leaking to an outside of the detergent suctioner while the detergent pump is being docked at the detergent container and a second hole sealing member positioned to surround an outer side of the detecting member and configured to seal the second detergent container hole while the first detergent container hole is sealed by the first hole sealing member so that the detergent is prevented from leaking to an outside of the detecting member.

In response to the pressing the detergent compartment valve by the detergent suctioner and opening the plurality of detergent container holes while the detergent pump is docked at the detergent container, the first hole sealing member and the second hole sealing member may simultaneously seal the first detergent container hole and the second detergent container hole, respectively, to prevent the detergent from leaking to the outside of the detergent container.

The detecting member may be positioned on an upper side of the detergent suctioner, and the detergent suction port may be defined in a lower side of the detergent suctioner to be spaced apart from the detecting member.

An end of the detecting member may be positioned toward a front so that an amount of detergent remaining on the detecting member is reduced.

A diameter of the detergent suction port may be less than or equal to a distance at which the detergent suction port is spaced apart from a lower end of the detergent container.

The detecting member may include a pair of electrodes disposed adjacent to each other at left and right sides, respectively.

The detergent suctioner may be positioned between the pair of electrodes and below the pair of electrodes.

The detergent suctioner may come in contact with the detergent compartment valve from below the detergent compartment valve and press the detergent compartment valve, the detergent compartment valve may include a guide protrusion protruding to pass through a center of the valve case, the valve case may include an anti-rotation rib extending forward from a side thereof to prevent the valve case from rotating, and the detergent container may include an anti-rotation flange defined adjacent to one side of the anti-rotation rib to prevent a rotation of the anti-rotation rib.

In accordance with one aspect of the present disclosure, a detergent supply device includes a detergent container having a detergent accommodation space defined therein and a detergent pump detachably coupled to the detergent container, the detergent pump to pump a detergent accommodated in the detergent accommodation space, the detergent pump including a pair of electrodes to detect an amount of the detergent accommodated in the detergent accommodation space, the pair of electrodes extending forward to be inserted into the detergent accommodation space, and a front end of the pair of electrodes may face a front.

The detergent pump may further includes a detergent suctioner to suction the detergent accommodated in the detergent accommodation space into the detergent pump, the detergent suctioner extends forward and to be inserted into the detergent accommodation space.

A plurality of detergent container holes including a first detergent container hole defined in a rear of the detergent container and defined to correspond to the detergent suctioner so that the detergent suctioner is accommodated in the detergent accommodation space and a second detergent container hole defined in the rear of the detergent container, defined to be apart from the first detergent container hole, and defined to correspond to the detergent suctioner so that the pair of electrodes are accommodated in the detergent accommodation space may be defined.

A detergent supply device includes a detergent container configured to form a detergent accommodation space and a detergent pump detachably coupled to the detergent container and provided to pump a detergent accommodated in the detergent accommodation space, wherein, to detect an amount of detergent placed in the detergent accommodation space, the detergent pump includes a detecting member which extends forward and is able to be positioned inside the detergent accommodation space.

To suction the detergent placed in the detergent accommodation space into the detergent pump, the detergent pump may further include a detergent suctioner which extends forward and is able to be positioned inside the detergent accommodation space.

A plurality of detergent container holes including a first detergent container hole defined in a rear of the detergent container and defined to correspond to the detergent suctioner so that the detergent suctioner is accommodated in the detergent accommodation space and a second detergent container hole defined in the rear of the detergent container, defined to be apart from the first detergent container hole, and defined to correspond to the detecting member so that the detecting member is accommodated in the detergent accommodation space may be defined.

A detergent supply device may comprising: a detergent container having a detergent accommodation space formed therein; and a detergent pump detachably coupled to the detergent container, the detergent pump to pump a detergent accommodated in the detergent accommodation space, the detergent pump including a pair of electrodes to detect an amount of the detergent accommodated in the detergent accommodation space, the pair of electrodes extending forward to be inserted into the detergent accommodation space.

The detergent pump may further include a detergent suctioner to suction the detergent accommodated in the detergent accommodation space into the detergent pump, the detergent suctioner extends forward and to be inserted into the detergent accommodation space.

The detergent container may have a plurality of detergent container holes including a first detergent container hole formed in a rear side of the detergent container and corresponding to the detergent suctioner so that the detergent suctioner passes through the first detergent container hole and is accommodated in the detergent accommodation space and a second detergent container hole formed in the rear side of the detergent container, formed to be apart from the first detergent container hole, and corresponding to the detergent suctioner so that the pair of electrodes pass through the second detergent container hole and are accommodated in the detergent accommodation space.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
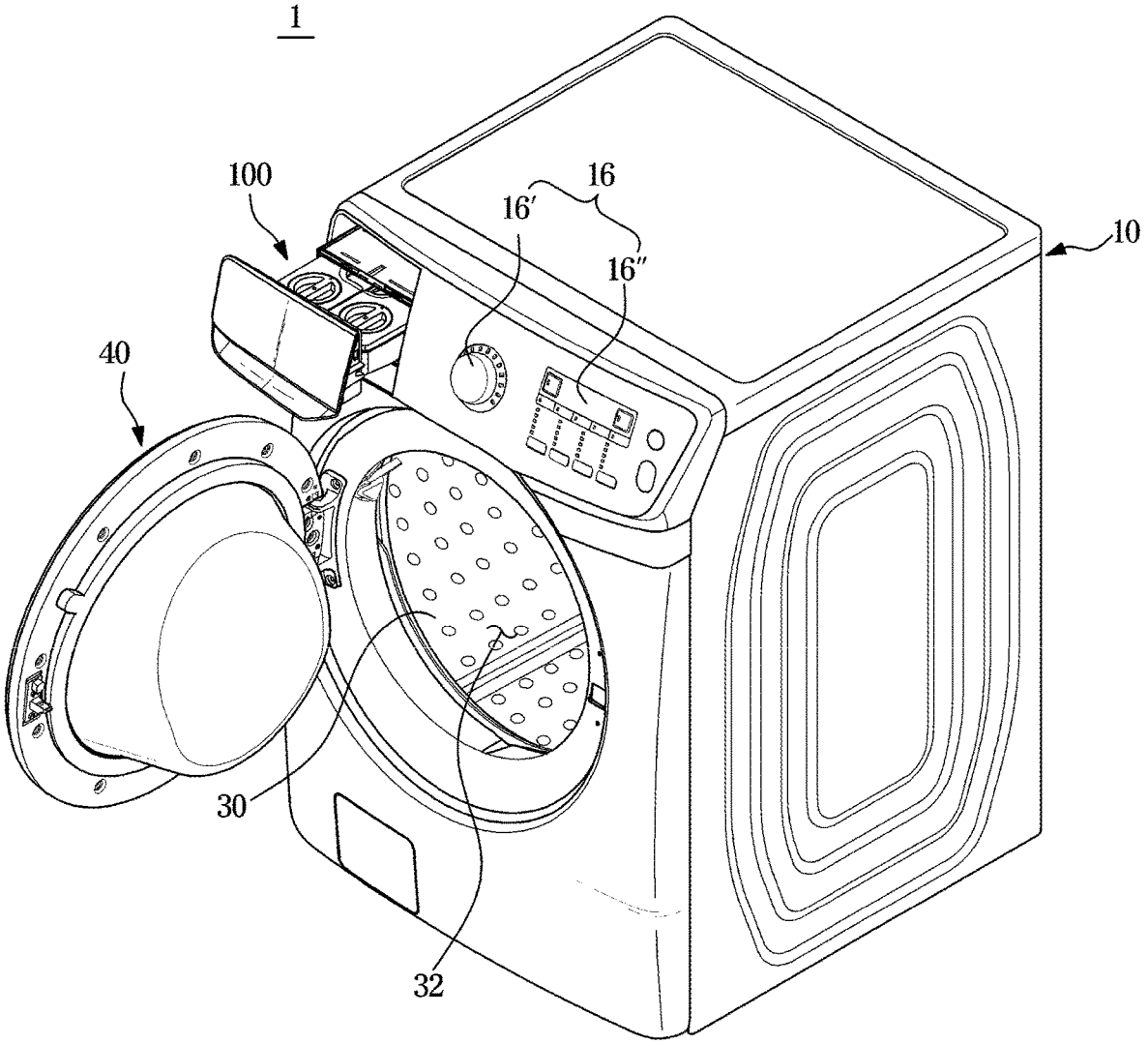
FIG. 1 is a perspective view of a washing machine according to one embodiment of the present disclosure.

Embodiments described herein and configurations illustrated in the drawings are merely exemplary embodiments of the present disclosure, and various modifications which may replace the embodiments and the drawings herein may be present at the time of filing this application.

Like reference numerals or symbols presented in the drawings of the application indicate parts or elements that perform substantially the same functions.

Terms used herein are for describing the embodiments and are not intended to limit and/or restrict the disclosure. A singular expression includes a plural expression unless context clearly indicates otherwise. In the application, terms such as "include" or "have" are for designating that features, numbers, steps, operations, elements, parts, or combinations thereof are present, and do not preclude the possibility of presence or addition of one or more other features, numbers, steps, operations, elements, parts, or combinations thereof in advance.

Terms including ordinals such as "first" and "second" used herein may be used to describe various elements, but the elements are not limited by the terms, and the terms are only used for the purpose of distinguishing one element from another element. For example, a first element may be referred to as a second element while not departing from the scope of the present disclosure, and likewise, a second element may also be referred to as a first element. The term "and/or" includes a combination of a plurality of associated listed items or any one item among the plurality of associated listed items.

Meanwhile, terms such as "up-down direction," "below," and "front-rear direction" used in the following description are defined based on the drawings, and the shape and position of each element are not limited by the terms.

Specifically, as illustrated in FIG. 1, a direction in which a detergent container 200 of a detergent supply device 100 is withdrawn is defined as the front, and the rear, left and right, and above and below are defined based on the front.

Hereinafter, embodiments according to the present disclosure will be described in detail with reference to the accompanying drawings.

FIG. 1 is a perspective view of a washing machine 1 according to one embodiment of the present disclosure. More specifically, FIG. 1 is a perspective view illustrating a state in which a door 40 of the washing machine 1 is open and the detergent container 200 is withdrawn.

The washing machine 1 refers to a device that spins laundry put into a washing chamber 32, washing water, and a detergent together using a driving force of a motor 61 so that the laundry is washed by being rubbed against the washing water and detergent. Here, the laundry may be clothes. In a case in which the laundry is clothes, the washing machine 1 may be referred to as a clothes handling apparatus.

The washing machine 1 may be classified into a drum-type washing machine that rotates a drum 30 and causes laundry to repeat rising and falling to wash the laundry and a motor-operated washing machine that washes laundry using a water flow generated by a pulsator when the drum 30 rotates.

The washing machine 1 may also be classified according to a direction in which laundry is put into the washing chamber 32. The washing machine 1 may be classified into a front-loading type washing machine 1 in which laundry is put into the washing chamber 32 from the front and a top-loading type washing machine 1 in which laundry is put into the washing chamber 32 from above.

A front-loading type washing machine which is also a drum-type washing machine is illustrated as an example of the washing machine 1 in FIG. 1, but the washing machine 1 is not limited thereto, and aspects disposed below may also apply to other types of washing machines.

As illustrated in FIG. 1, the washing machine 1 may include a cabinet 10 configured to form an exterior and accommodate various components therein. The cabinet 10 may be formed in a substantially rectangular parallelepiped shape.

A control panel 16 including an input device 16' configured to receive an operational command from a user and a display 16" configured to display operational information of the washing machine 1 may be provided on a front surface of the cabinet 10.

An opening may be formed in the front surface of the cabinet 10 so that laundry can be put into the drum 30. The opening formed in the front surface of the cabinet 10 may be opened or closed by the door 40. The door 40 may be rotatably mounted on the front surface of the cabinet 10 by a hinge member (not illustrated).

The washing machine 1 may include the detergent supply device 100. The detergent supply device 100 is a device that allows a detergent to be supplied into a tub 20 of the washing machine 1. Although the detergent supply device 100 is illustrated in FIG. 1 as being provided on an upper right side of the washing machine 1, this is only an example, and the present disclosure is not limited thereto.

Specific configurations of the detergent supply device 100 and the washing machine 1 including the same will be further described below.

Figure 2:
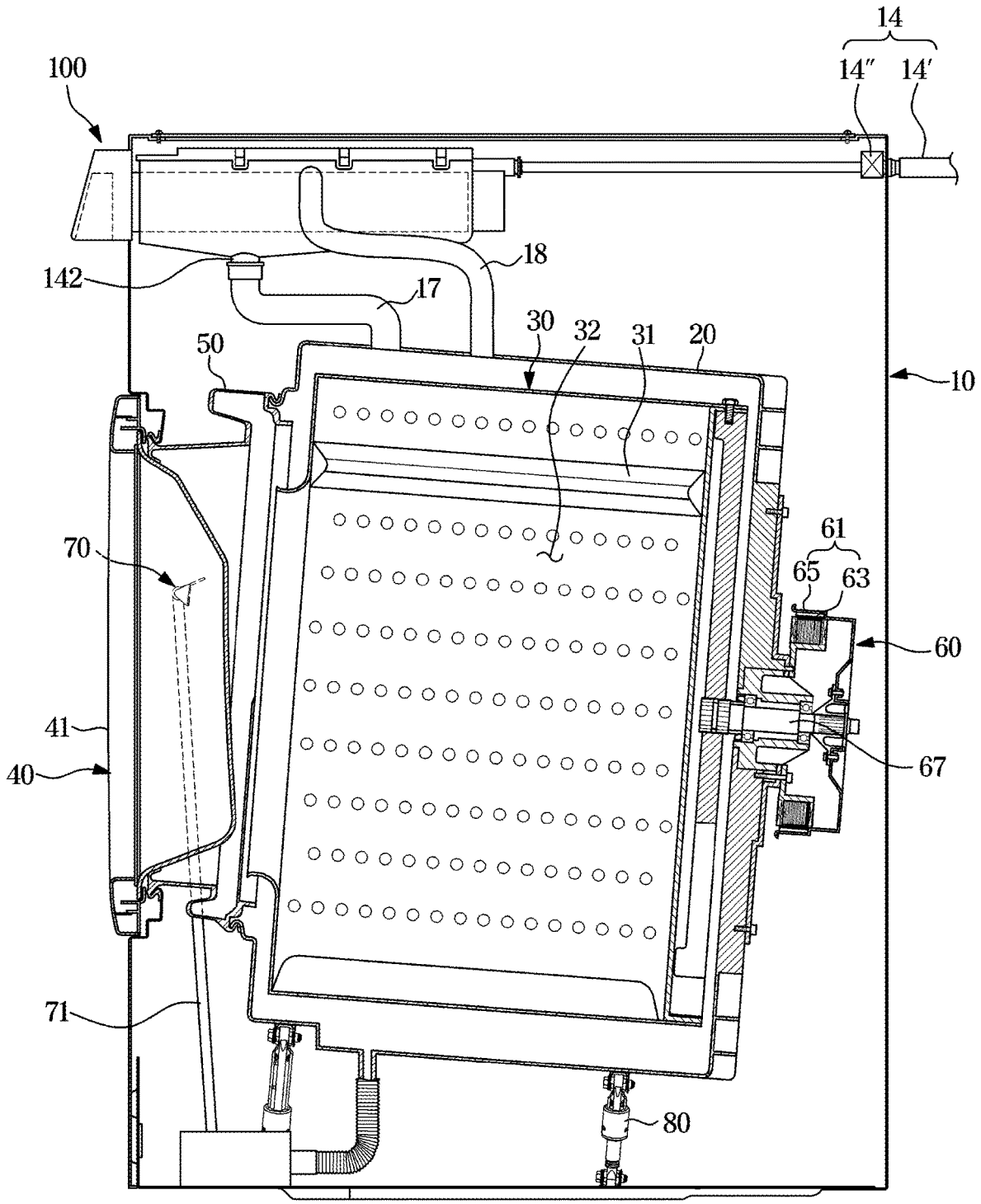
FIG. 2 is a cross-sectional view of the washing machine of FIG. 1.

FIG. 2 is a cross-sectional view of the washing machine 1 of FIG. 1.

As illustrated in FIG. 2, the cabinet 10 forming the exterior of the washing machine 1 may include the tub 20 provided to store mixed water in which water and a detergent are mixed. The drum 30 forming the washing chamber 32 to accommodate laundry may be provided inside the tub 20. In other words, it can be said that the drum 30 is provided in the cabinet 10 and has the washing chamber 32 formed therein.

An opening may be formed in each of the tub 20 and the drum 30 to allow laundry to be put in or taken out through the front of the cabinet 10, and the openings of the tub 20 and the drum 30 may be positioned to correspond to the opening in the front surface of the cabinet 10.

The opening provided in the front surface of the cabinet 10 may be opened or closed by the door 40. The door 40 may include a door frame 41 and a door glass. The door glass may be formed of a transparent tempered glass material so that an inside of the cabinet 10 is transparent.

A water supply device 14 including a water supply pipe 14' and a water supply valve 14" configured to control water supply may be provided on an upper portion of the tub 20. Also, the detergent supply device 100 configured to supply a detergent into the tub 20 in a water supply process may be installed on an upper front portion of the tub 20.

The detergent supply device 100 may be connected to the tub 20 through a connection pipe 17. Water supplied through the water supply pipe 14' may be mixed with a detergent via the detergent supply device 100, and the mixed water in which the water and the detergent are mixed may be supplied into the tub 20. In a case in which the detergent is a liquid detergent, the water supply pipe 14' may directly supply water into the tub 20 through a separate control valve (not illustrated), and the liquid detergent may be supplied into the tub 20 through a detergent supply pipe (not illustrated) via the detergent supply device 100.

The detergent supply device 100 may be connected to the tub 20 through an air pipe 18. The air pipe 18 may be provided to allow air to flow into and/or flow out of the detergent supply device 100. Accordingly, the air pipe 18 can prevent a decrease in pressure inside the detergent supply device 100.

A driving unit 60 may be disposed behind the drum 30. The driving unit 60 is a configuration for rotating the drum 30 and may be provided to transmit a driving force generated from the motor 61 to a rotating shaft 67 to rotate the drum 30.

The motor 61 may be made of a stator 63 which is fixed and a rotor 65 which electromagnetically interacts with the stator 63 to rotate and may convert electric force into mechanical force and rotational force.

The tub 20 may store the mixed water in which the water and the detergent are mixed and may be formed in a substantially cylindrical shape. The tub 20 may be fixed inside the cabinet 10. The tub 20 and the opening formed in the front surface of the cabinet 10 may be connected by a diaphragm 50.

A spray nozzle 70 connected to a circulation hose 71 and configured to spray the mixed water circulating therein into the drum 30 may be provided on one side of the diaphragm 50. The spray nozzle 70 may be provided to spray the mixed water evenly throughout the laundry accommodated in the drum 30. The circulation hose 71 may be connected to a circulation pump configured to pump the stored mixed water from a lower portion of the tub 20.

The drum 30 may rotate inside the tub 20 and cause laundry to rise and fall to wash the laundry. A plurality of lifters 31 may be provided inside the drum 30.

A drain device (not illustrated) including a drain pipe (not illustrated), a drain valve (not illustrated), and the like for draining water from inside the tub 20 may be installed on the lower portion of the tub 20.

The tub 20 may be provided to be elastically supported in the cabinet 10 by a spring (not illustrated) at an upper portion and dampers 80 at a lower portion. That is, the spring and the dampers 80 may be provided to, while vibration generated during rotation of the drum 30 is transmitted to the tub 20 and the cabinet 10, absorb vibrational energy and attenuate vibration between the tub 20 and the cabinet 10.

Hereinafter, the configuration of the detergent supply device 100 will be described in more detail.

Figure 3:
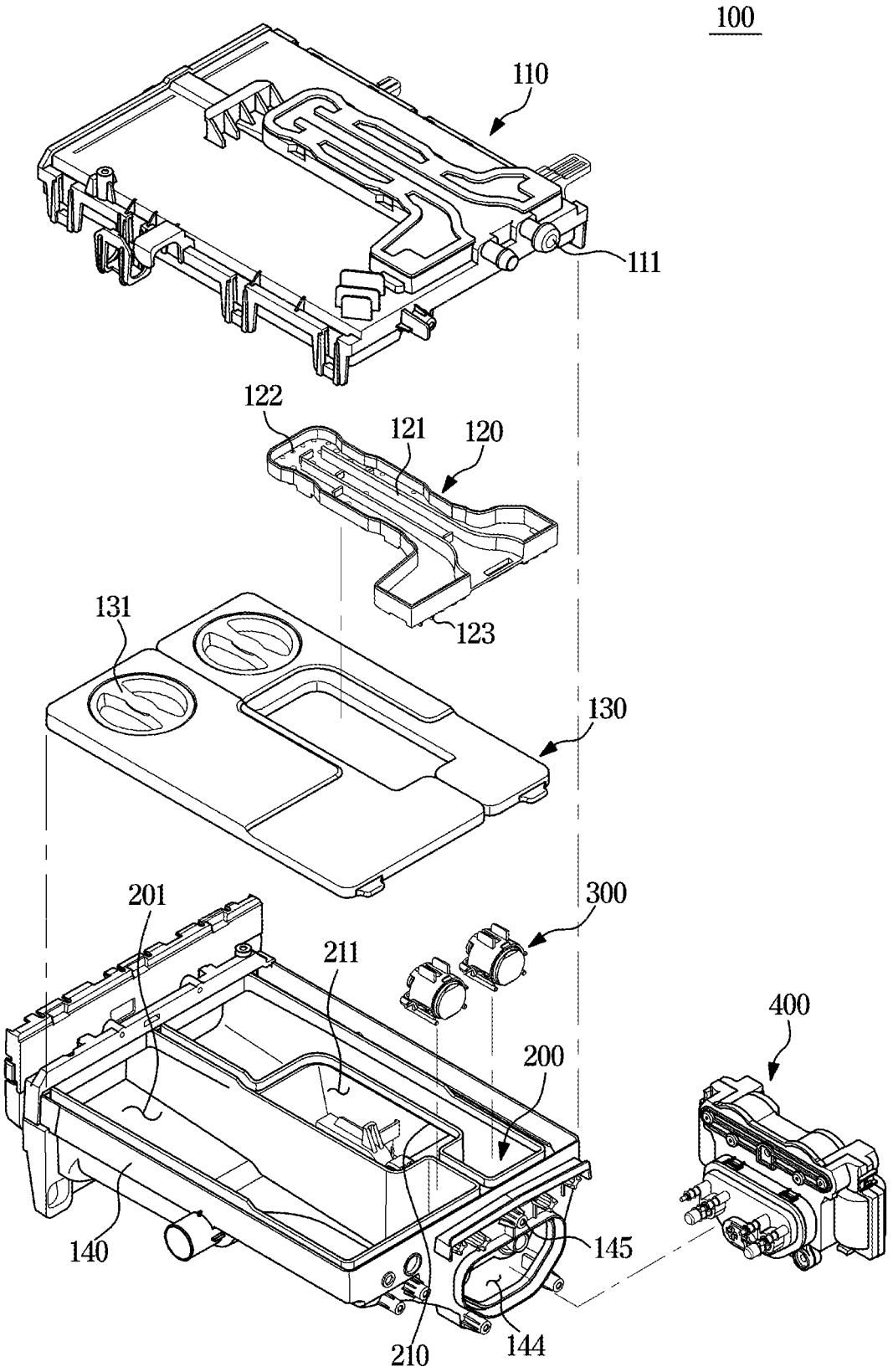
FIG. 3 is a rear exploded view of a detergent supply device of FIG. 2.

FIG. 3 is a rear exploded view of the detergent supply device 100 of FIG. 2.

As illustrated in FIG. 3, the detergent supply device 100 may include a cover 110. The cover 110 may form an exterior of the detergent supply device 100 together with a housing 140. The cover 110 may be coupled to an upper portion of a water supply plate 120 and seal the water supply plate 120. In other words, the cover 110 may be coupled to the water supply plate 120 and form a flow path along which washing water supplied from the water supply device 14 moves.

The cover 110 may include a washing water inlet 111 connected to the water supply device 14. Washing water may flow into the detergent supply device 100 through the washing water inlet 111.

The detergent supply device 100 may further include the water supply plate 120 coupled to the cover 110 and disposed between the cover 110 and the housing 140. The water supply plate 120 may include a guide partition 121 configured to partition a flow path to allow washing water to flow therein. Together with the cover 110, the water supply plate 120 may form the flow path along which the washing water supplied from the water supply device 14 moves.

The water supply plate 120 may include a washing water movement hole 122 provided to allow washing water, which is supplied from the water supply device 14 to a space between the cover 110 and the water supply plate 120, to be discharged to a water supply chamber 211. The washing water movement hole 122 may be formed to pass through the water supply plate 120. The washing water movement hole 122 may be formed in one area of the water supply plate 120 to correspond to the water supply chamber 211. In other words, the washing water movement hole 122 may be formed in one area of the water supply plate 120 that faces the water supply chamber 211.

In order to prevent a detergent, which is discharged to a mixing chamber 141 (see FIG. 15) by a detergent discharger 540 (see FIG. 4) of a detergent pump 400, from remaining in the mixing chamber 141, the water supply plate 120 may include a through-hole 123 provided to allow passage of a portion of the washing water supplied from the water supply device 14. The through-hole 123 may be disposed upstream of the washing water movement hole 122 in a direction in which the washing water supplied from the water supply device 14 moves. In other words, the through-hole 123 may be formed in the water supply plate 120 so as to be adjacent to the washing water inlet 111. A portion of the washing water supplied from the water supply device 14 may be discharged to the water supply chamber 211 through the washing water movement hole 122, and the rest of the washing water may be discharged to the mixing chamber 141 through the through-hole 123.

The detergent supply device 100 may further include the housing 140 configured to form the exterior of the detergent supply device 100 together with the cover 110. In order to allow withdrawal of the detergent container 200 in which a detergent accommodation space 201 is formed to accommodate a detergent, the housing 140 may be coupled to the detergent container 200.

Figure 15:
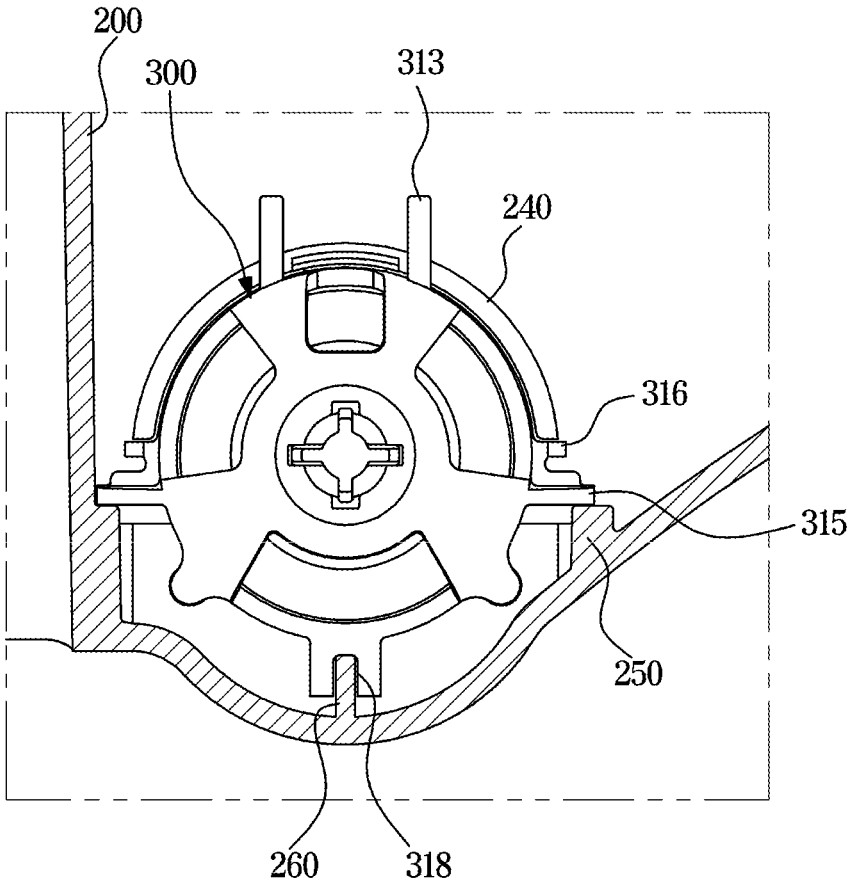
FIG. 15 is a front view of the detergent compartment valve module of FIG. 14 coupled to the rear of the detergent container.

Referring to FIG. 15, an outlet 142 may be formed in a lower portion of the housing 140 to allow at least one of washing water and a detergent to be discharged to an outside of the detergent supply device 100. The outlet 142 is connected to a connection pipe 17 (see FIG. 2), and at least one of washing water and a detergent discharged through the outlet 142 moves into the tub 20 via the connection pipe 17. The lower portion of the housing 140 is formed to be inclined toward the outlet 142 to allow at least one of washing water and a detergent to be smoothly discharged through the outlet 142 without accumulating on the lower portion of the housing 140.

The detergent supply device 100 may include the detergent container 200 including the detergent accommodation space 201 in which a detergent may be accommodated.

Although the detergent container 200 is illustrated in FIG. 3 as being formed as one body, the detergent container 200 may include a detergent compartment (not illustrated) configured to form the detergent accommodation space 201 in which a detergent may be accommodated and an inner housing (not illustrated) configured to accommodate the detergent compartment.

The detergent container 200 may be movably mounted on the housing 140. A liquid detergent may be accommodated in the detergent container 200. Examples of the liquid detergent may include a rinse, a fabric softener, and the like.

A detergent container cover 130 may be provided above the detergent container 200 to cover the detergent container 200. The detergent container cover 130 may be formed to correspond to the shape of an upper side of the detergent container 200. However, at a position that corresponds to the washing water movement hole 122 of the water supply plate 120, the detergent container cover 130 may not be formed to allow movement of washing water.

A detergent container cap 131 may be provided in front of the detergent container cover 130 to allow a detergent to be added into the detergent accommodation space 201. The detergent container cap 131 may be detachably coupled to the detergent container cover 130.

The detergent supply device 100 may further include the water supply chamber 211 formed in the detergent container 200 to allow an inflow of washing water which has passed through the washing water movement hole 122. The water supply chamber 211 may be defined by a water supply chamber frame 210 of the detergent container 200. The washing water which has passed through the washing water movement hole 122 may directly flow into the water supply chamber 211. Washing water supplied between the cover 110 and the water supply plate 120 may easily pass through the washing water movement hole 122 due to gravity and flow into the water supply chamber 211.

A powder detergent may be added into the water supply chamber 211 in some cases. In a case in which a powder detergent is added into the water supply chamber 211, the powder detergent may flow into the mixing chamber 141 together with washing water flowing in through the washing water movement hole 122. A communication hole (see FIG. 15) may be formed in a lower side of the water supply chamber 211. The water supply chamber 211 and the mixing chamber 141 may be provided to communicate with each other.

The detergent supply device 100 may further include the mixing chamber 141 provided to allow at least one of washing water discharged from the water supply chamber 211 and a detergent discharged from the detergent container 200 to pass and be supplied to the tub 20 (see FIG. 2). The mixing chamber 141 may be formed between the detergent container 200 and the housing 140.

The detergent supply device 100 may include the detergent pump 400 provided to suction a detergent from the detergent container 200 and discharge the suctioned detergent to the mixing chamber 141.

Hereinafter, the detergent pump 400 will be described in more detail.

Figure 4:
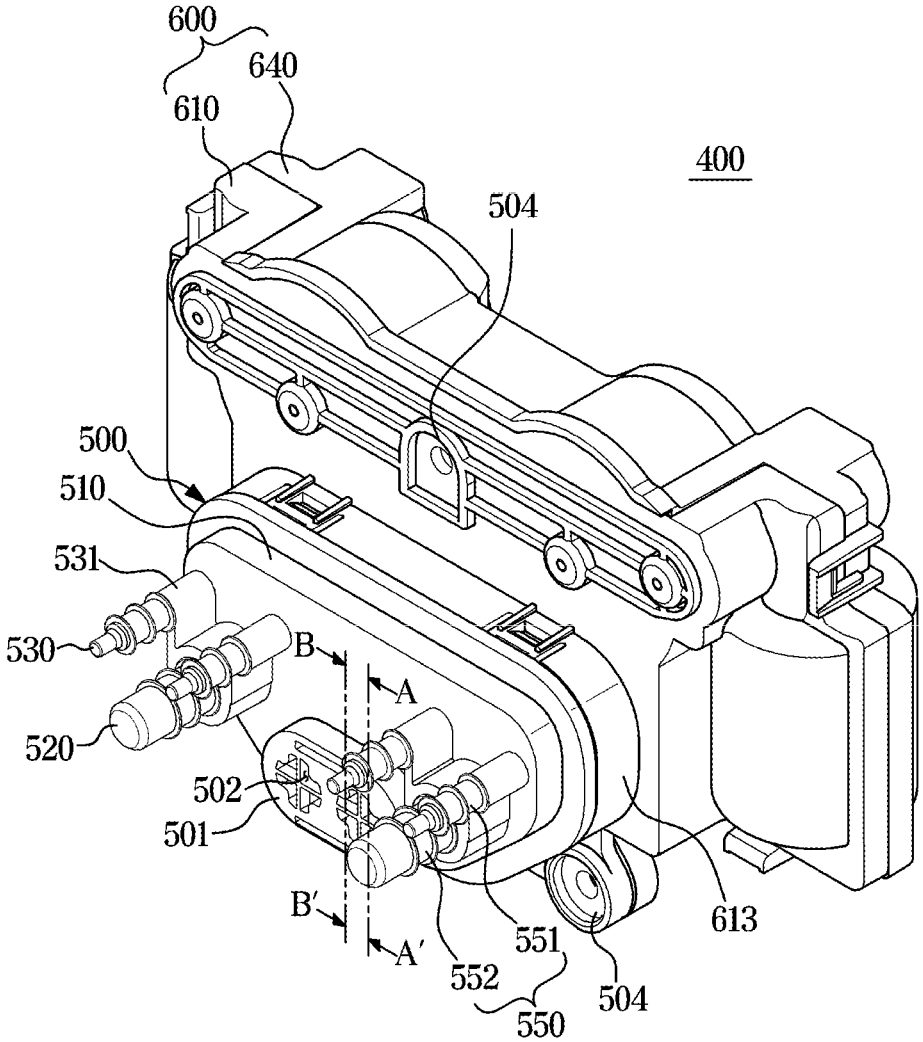
FIG. 4 is a perspective view of a detergent pump of the detergent supply device of FIG. 3.

FIG. 4 is a perspective view of the detergent pump 400 of the detergent supply device 100 of FIG. 3.

As illustrated in FIG. 4, the detergent pump 400 may include cases 500 and 600 configured to form an exterior thereof.

The cases 500 and 600 may include a front case 500 configured to form a front exterior and a rear case 600 coupled to a rear of the front case 500. For convenience of manufacture, the rear case 600 may include a middle case 610 coupled to the front case 500 from behind the front case 500 and a case cover 640 coupled to the middle case 610 from behind the middle case 610.

The front case 500, the middle case 610, and the case cover 640 which constitute the cases 500 and 600 may be vertically symmetrical about the center of the detergent pump 400. In other words, since the detergent container cap 131 (see FIG. 3) allowing a detergent to be added into the detergent container 200 may be formed as a pair of detergent container caps 131 at left and right sides, the cases 500 and 600 having configurations corresponding thereto may be formed to be vertically symmetrical.

Further, all configurations described below may be formed to be vertically symmetrical about a center of the detergent pump 400.

Figure 7:
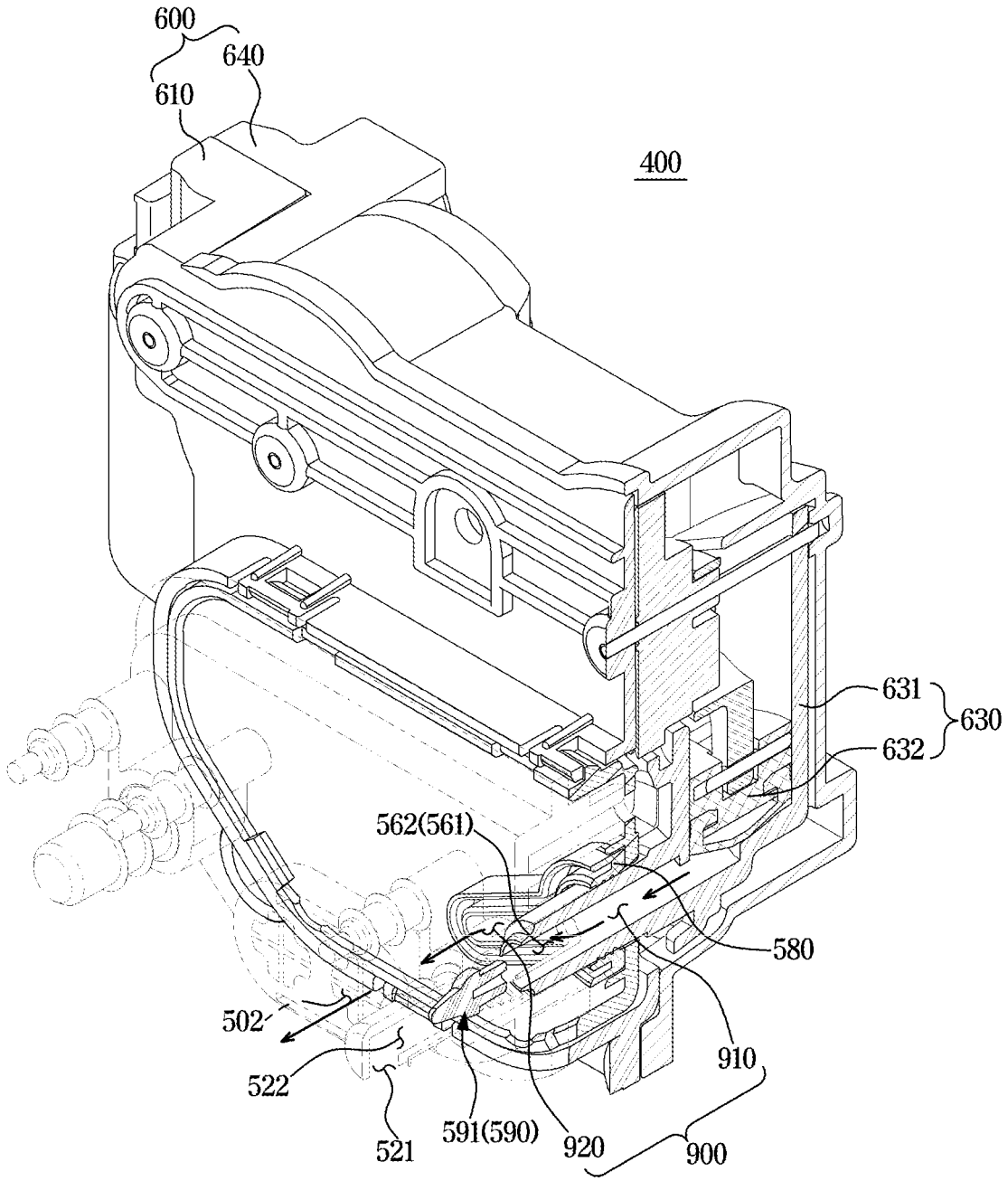
FIG. 7 is a cross-sectional perspective view illustrating a process in which a detergent flown into the detergent pump of FIG. 6 flows out.

Referring to FIG. 7, in a case in which the cases 500 and 600 are produced by an injection molding process, in order to facilitate the production, the middle case 610 may include a middle outer case 611 disposed at an outer side and a middle inner case 612 provided at an inner side of the middle outer case 611 and provided to correspond to the rear of the front case 500.

The front case 500 may include a front case body 510. The front case 500 may include a detergent suctioner 520 which extends from the front case body 510 in a direction in which the detergent pump 400 is coupled to the detergent container 200 and which forms a suctioning space 521 therein. In other words, the detergent suctioner 520 may extend forward, and the suctioning space 521 may be formed in the detergent suctioner 520.

The front case 500 may include the detergent discharger 540 which extends forward from the front case body 510 and forms a discharging space 541 therein. In other words, the detergent discharger 540 may extend forward, and the discharging space 541 may be formed in the detergent discharger 540.

The detergent suctioner 520 may be directly inserted into the detergent accommodation space 201. In other words, in order to allow the detergent pump 400 to suction a detergent placed in the detergent accommodation space 201 into the detergent pump 400, the detergent suctioner 520 may extend forward and be positioned in the detergent accommodation space 201.

The detergent suctioner 520 can directly press a detergent compartment valve 320 in a detergent compartment valve module 300 (see FIG. 12) which will be described below and, simultaneously, allows a detergent suction port 522, through which a detergent flows into the detergent container 200, to be positioned. In this way, an inflow of a detergent into the detergent pump 400 can be controlled using a simple configuration.

In a case in which the detergent suctioner 520 presses the detergent compartment valve 320, since a front of the detergent suctioner 520 presses the detergent compartment valve 320, the detergent suction port 522 of the detergent suctioner 520 may be formed in a side of the detergent suctioner 520.

Further, due to such a configuration, a configuration that causes a detergent to flow to an outside of the detergent container 200 and flow back into the detergent pump 400 is not taken. Accordingly, leakage of a detergent can be prevented while the detergent pump 400 is undocked from the detergent container 200.

A detecting member 530 configured to measure an amount of detergent remaining in the detergent accommodation space 201 may be provided adjacent to the detergent suctioner 520. The detecting member 530 may come in contact with the detergent in the detergent accommodation space 201 and measure the amount of the detergent while the detergent pump 400 is coupled to the detergent container 200. Therefore, the detecting member 530 may be inserted into the detergent accommodation space 201.

In other words, in order to allow the amount of detergent placed in the detergent accommodation space 201 to be detected, the detergent pump 400 may include the detecting member 530 which protrudes or extends forward and is able to be positioned inside the detergent accommodation space 201.

In a case in which a detergent and the detecting member 530 come into contact with each other outside the detergent container 200 and the detecting member 530 detects the amount of detergent, a delay may occur in a process in which the detergent moves to the outside of the detergent container 200. In addition, since the detecting member 530 is a configuration included in the detergent pump 400, in a case in which a separate space for detection is provided, a detergent provided in the separate space for detection may leak while the detergent pump 400 is separated from the detergent container 200.

The detecting member 530 may have a shape that extends forward. In a case in which the detecting member 530 has a bent shape, the probability that a residual detergent is present on the detecting member 530 increases due to the bent shape. Therefore, the detecting member 530 may have a shape that extends forward in a straight line.

In other words, an end of the detecting member 530 may be positioned toward a front so that an amount of residual detergent present on the detecting member 530 is reduced.

The detecting member 530 may be positioned adjacent to the detergent suction port 522.

The detecting member 530 may be positioned above the detergent suctioner 520.

As will be described below, the detergent suctioner 520 may press the detergent compartment valve 320 of the detergent compartment valve module 300 to control an inflow of a detergent into the detergent pump 400. Therefore, the detergent suction port 522, which is an inlet of the detergent suctioner 520 through which a detergent flows in, may be formed in the side instead of the front.

Here, the detergent suction port 522 may be provided at the lowermost side while the detergent pump 400 is inserted into the detergent container 200. This is because, as the detergent in the detergent container 200 is used, a fill level of the detergent drops due to gravity and eventually approaches a bottom surface of the detergent container 200. In order to suction as much detergent as possible from the detergent container 200, the detergent suction port 522 may be positioned to face the bottom.

The detecting member 530 may be spaced as far from the detergent suction port 522 as possible. A force acts to suction a detergent from the detergent suction port 522. Since the detecting member 530 can detect the amount of detergent only when in contact with the detergent, in a case in which the detergent suction port 522 and the detecting member 530 are positioned close to each other, the detergent that should be detected by the detecting member 530 may be sucked into the detergent suction port 522, and sensitivity of the detecting member 530 detecting the amount of detergent may be decreased.

In a case in which the detecting member 530 is spaced apart from the detergent suction port 522, the detergent suction port 522 may be positioned in a bottom of the detergent container 200. Therefore, the detecting member 530 may be positioned above the detergent suctioner 520 in order to be positioned inside the detergent accommodation space 201 inside the detergent container 200. In other words, the detergent suction port 522 may be formed in a lower side of the detergent suctioner 520 in order to be spaced apart from the detecting member 530.

To sum up, the detergent suction port 522 may be positioned close to the bottom of the detergent container 200, and the detecting member 530 spaced apart from the detergent suction port 522 may be positioned above the detergent suctioner 520.

As it will be described below, together with the detergent suctioner 520, the detecting member 530 may be docked at the detergent accommodation space 201 formed in the detergent container 200. In a case in which the detecting member 530 and the detergent suctioner 520 are docked at the detergent container 200 by passing through a rear surface of the detergent container 200, the detecting member 530 may be positioned to be spaced apart from the detergent suctioner 520 through a lower side of the detergent container 200 rather than being spaced apart from the detergent suctioner 520 over an upper end of the detergent container 200.

However, the detecting member 530 may detect a predetermined fill level of a detergent and, in a case in which a fill level drops below the predetermined fill level, send a signal indicating that the amount of detergent is insufficient. In this case, the detecting member 530 may be positioned at a height that corresponds to the predetermined fill level.

The detecting member 530 may be inserted into a terminal accommodator 602 that the middle case 610 includes. A terminal 604 configured to come in contact with the detecting member 530 and supply power to the detecting member 530 may be positioned inside the terminal accommodator 602.

The detecting member 530 may be configured to detect a residual amount of detergent in a detergent compartment when current is generated by the terminal 604 electrically connected to the detecting member 530. The detecting member 530 may be positioned inside the detergent compartment.

The closer the detergent suction port 522 is to the bottom of the detergent container 200, the greater the amount of detergent flowing into the detergent pump 400 from the detergent container 200. However, in a case in which the detergent suction port 522 and the bottom of the detergent container 200 are too close, loss may occur during the inflow of the detergent.

Generally, loss occurs when a fluid moves from a pipe having a narrow cross-sectional area to a pipe having a wide cross-sectional area. As the cross-sectional area of the pipe along which the fluid moves increases, the speed of the fluid decreases, and pressure of the fluid increases in this process. For a fluid having viscosity, such as a detergent, instead of an ideal fluid, loss may occur at a point where the shape of the pipe changes as above.

In a case in which the detergent suctioner 520 is too close to the bottom of the detergent container 200, a cross-sectional area of the detergent suction port 522 becomes larger than a cross-sectional area of a detergent flow that is formed between the bottom of the detergent container 200 and the detergent suctioner 520. In this case, energy loss of the detergent flow may occur. In order to improve efficiency of the detergent pump 400, the detergent suctioner 520 may not be too close to the bottom of the detergent container 200 so that a cross-sectional area of a detergent flow entering the detergent suction port 522 does not widen.

Here, in a case in which the detergent suction port 522 has a circular shape, a diameter of the detergent suction port 522 may be less than or equal to a distance at which the detergent suction port 522 is spaced apart from a lower end of the detergent container 200.

The detecting member 530 may include a pair of electrodes 530. Since a detergent may be an electrolyte that conducts electricity, current may flow between the pair of electrodes 530 dipped in a detergent. By current flowing between the pair of electrodes 530, a decrease in the amount of detergent in the detergent accommodation space 201 to a value less than or equal to a predetermined value may be measured. In other words, the detecting member 530 may be the pair of electrodes 530 provided adjacent to each other at left and right sides.

A detecting member case 531 configured to surround the detecting member 530 and extend forward from the front case body 510 may be provided to protect the detecting member 530. The detecting member 530 may extend past the detecting member case 531 and come in contact with a detergent.

In a case in which the detecting member 530 is the pair of electrodes 530, a second detergent container hole 222 formed to correspond to the detecting member 530 may be a pair of second detergent container holes 222 provided to correspond to the pair of electrodes 530.

The detergent suctioner 520 may be positioned between the pair of electrodes 530 and below the pair of electrodes 530. Through such arrangement of the pair of electrodes 530 and the detergent suctioner 520, an area having the detergent suctioner 520 and the pair of electrodes 530 as vertices may be narrowed. Since the detergent suctioner 520 and the pair of electrodes 530 may be inserted into the detergent accommodation space 201 together, the arrangement in which the detergent suctioner 520 and the pair of electrodes 530 are positioned close to each other may be considered a structure that facilitates insertion into the detergent accommodation space 201.

The detergent suctioner 520 may be positioned at a lower side between the pair of electrodes 530.

A hole sealing member 550 may be provided in front of the detergent suctioner 520 and in front of the detecting member case 531. A plurality of detergent container holes 220 into which the detergent suctioner 520 and the detecting member case 531 can be inserted may be provided in a rear of the detergent container 200. The hole sealing member 550 may be provided to prevent leakage of a detergent between the plurality of detergent container holes 220 and the detergent suctioner 520 or the detecting member case 531.

The plurality of detergent container holes 220 may include a first detergent container hole 221 formed in the rear of the detergent container 200 and formed to correspond to the detergent suctioner 520 so that the detergent suctioner 520 is accommodated in the detergent accommodation space 201 and a second detergent container hole 222 formed in the rear of the detergent container 200, formed to be apart from the first detergent container hole 221, and formed to correspond to the detecting member 530 so that the detecting member 530 is accommodated in the detergent accommodation space 201.

In this way, the detergent suctioner 520 and the detecting member 530 may be separately inserted into the detergent accommodation space 201.

Since the detergent suctioner 520 and the detecting member 530 may include a shape that extends forward from the front case body 510, while the detergent pump 400 is docked at the detergent container 200, the detergent suctioner 520 and the detecting member 530 may be simultaneously accommodated in the suctioning space 521.

The middle case 610 may have a case opening (not illustrated) formed therein to accommodate the front case 500. The case opening may be formed by a case opening frame 613 which is formed to surround the case opening and extends forward. The case opening may be provided in a shape that corresponds to the shape of a rear edge of the front case 500. Therefore, the case opening frame 613 may guide accommodation of the front case 500 in the case opening of the middle case 610.

In order to have a reinforced strength, the middle case 610 may include a support rib 504 provided above the case opening frame 613.

The support rib 504 may include a shape that corresponds to a position corresponding to a support protrusion 145 (see FIG. 3) formed on a rear of the housing 140. When impact is applied to the detergent pump 400, the impact can be distributed due to the support rib 504 and the support protrusion 145.

Figure 5:
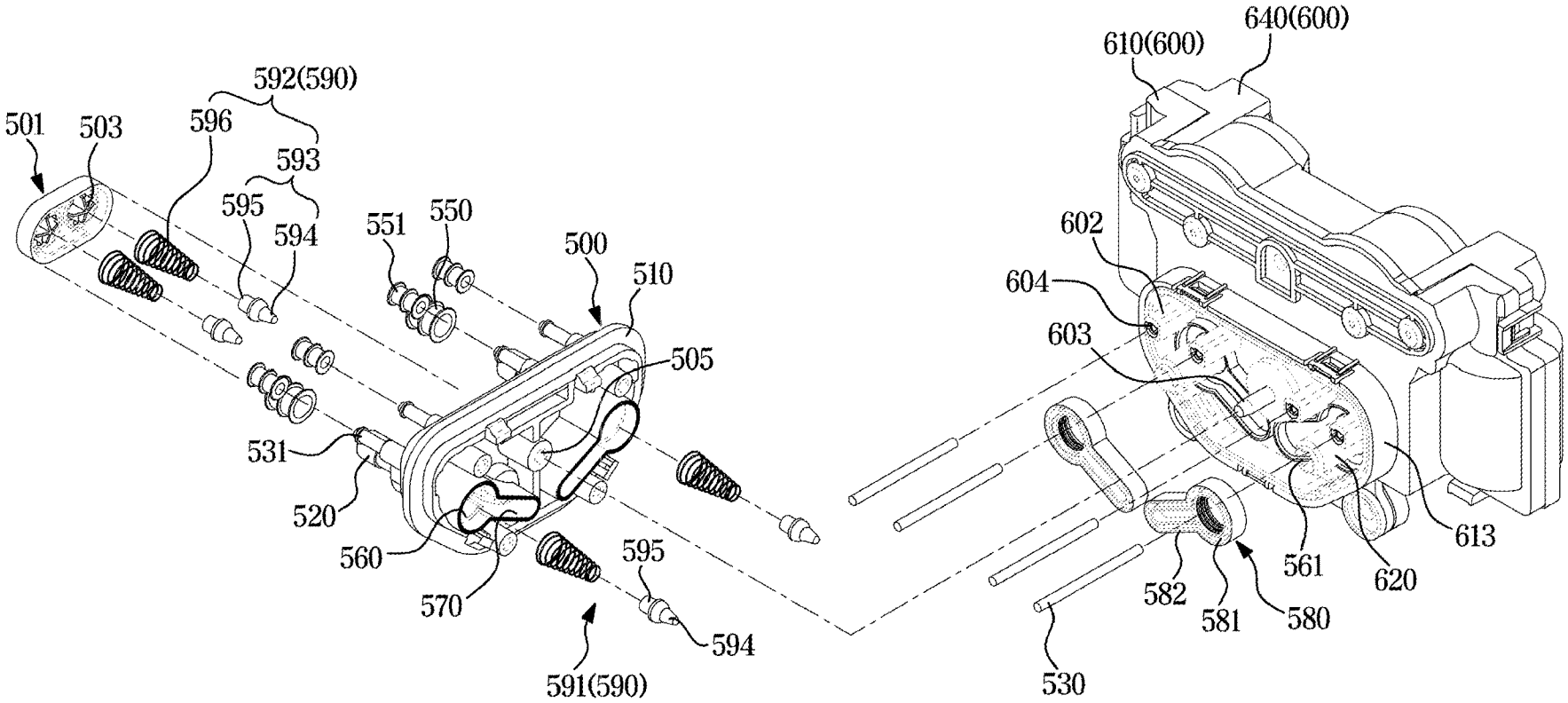
FIG. 5 is an exploded view of the detergent pump of FIG. 4.

FIG. 5 is an exploded view of the detergent pump 400 of FIG. 4.

As illustrated in FIG. 5, a detergent outflow cap 501 may be provided in front of the detergent discharger 540 to protect the detergent discharger 540. A detergent outflow opening 502 (see FIG. 4) may be provided in a front of the detergent outflow cap 501 to allow an outflow of a detergent.

A check valve module 590 may be provided to open or close a flow path along which a detergent moves. The check valve module 590 may include a check valve body 593 provided to open or close the flow path along which the detergent moves and an elastic member 596 configured to elastically bias the check valve body 593 so that the check valve body 593 blocks the flow path along which the detergent moves. The check valve body 593 and the elastic member 596 will be described in more detail below in relevant parts.

The check valve module 590 may be formed adjacent to the detergent discharger 540. Since the check valve module 590 may include the elastic member 596, the detergent outflow cap 501 may have a falling prevention rib 503 provided at a position corresponding to the elastic member 596 so that the elastic member 596 is supported. In a case in which the falling prevention rib 503 is provided as a plurality of falling prevention ribs 503, the detergent outflow opening 502 (see FIG. 4) may be formed between the falling prevention ribs 503 to allow movement of a detergent.

Here, the check valve module 590 on a side adjacent to the detergent suctioner 520 may be referred to as a first check valve module 591. The check valve module 590 on a side adjacent to the detergent discharger 540 may be referred to as a second check valve module 592. In other words, the check valve module 590 may include the first check valve module 591 configured to open or close a detergent discharge flow path 900 by a pumper 630 on a side where an inflow of a detergent occurs and the second check valve module 592 configured to open or close the detergent discharge flow path 900 by the pumper 630 on a side where an outflow of the detergent occurs.

The detergent discharge flow path 900, which will be described below, may be a detergent space formed from the first check valve module 591 to the second check valve module 592. However, this is only one method of partitioning the space, and the detergent discharge flow path 900 may be any other space as long as it is a flow path present on a path along which a detergent is discharged.

The front case 500 may include a front insertion pipe 560 which is coupled to a rear of the detergent suctioner 520 to extend rearward from the front case body 510 and which forms a front common flow path 911 therein. The front common flow path 911 (see FIG. 7) may be formed inside the front insertion pipe 560.

The rear case 600 may include a rear insertion pipe 620 which extends forward to be inserted into the front insertion pipe 560 and which forms a rear common flow path 912 (see FIG. 7). By the rear insertion pipe 620 being inserted into the front insertion pipe 560, the front case 500 may be coupled to the middle case 610 without a separate coupling member. In addition, of course, a coupling member (not illustrated) may be provided for the middle case 610 and the front case 500 to be stably coupled to each other. In this case, due to a structure in which the rear insertion pipe 620 is inserted into the front insertion pipe 560, the number of coupling members (not illustrated) provided to allow stable coupling between the front case 500 and the middle case 610 can be few.

In the present disclosure, although the rear insertion pipe 620 is described as being inserted into the front insertion pipe 560, aspects of the present disclosure may also apply to a structure in which the front insertion pipe 560 is included in the rear insertion pipe 620.

Here, since the front insertion pipe 560 and the rear insertion pipe 620 may be formed to be vertically symmetrical about the center of the detergent pump 400, by the rear insertion pipe 620 being inserted into the front insertion pipe 560, insertion positions of the front case 500 and the middle case 610 may be aligned.

The detecting member 530 may be the pair of electrodes 530 extending forward. The pair of electrodes 530 may be provided to be vertically symmetrical about the center of the detergent pump 400.

The middle case 610 may include a detecting member accommodator which extends forward so that the detecting member 530 may be inserted thereinto.

The middle case 610 may include a fixing member 603 which protrudes forward so that insertion of the front case 500 into the middle case 610 is guided. The front case 500 may include a fixer 505 provided at a position corresponding to the fixing member 603 so that the fixing member 603 is inserted thereinto.

The front case 500 may include a connection partition 570 which is connected to the front insertion pipe 560 and extends rearward so that a connection flow path 920 through which a detergent passes, which will be described below, may be formed.

The front case 500 may include a flow path sealing member 580 configured to seal a rear of the front insertion pipe 560 and a rear of the connection partition 570 to form the connection flow path 920.

A connection opening 561 configured to communicate with an outside of the front insertion pipe 560 may be formed in one side of the front insertion pipe 560. In a case in which the front insertion pipe 560 is formed as a pair of front insertion pipes 560 at left and right sides with respect to the center of the cases 500 and 600, a pair of connection openings 561 each formed in the pair of front insertion pipes 560 may be formed to each face the pair of front insertion pipes 560. In a case in which the pair of front insertion pipes 560 are provided on sides of the cases 500 and 600, since the connection openings 561 extending from such communication openings extend toward the center of the cases 500 and 600, the detergent pump 400 may be configured in a compact manner.

In a case in which the rear insertion pipe 620 is provided to be inserted into the front insertion pipe 560, and the rear insertion pipe 620 is inserted into the front insertion pipe 560 up to a point where the connection opening 561 is formed in the front insertion pipe 560 or over the point where the connection opening 561 is formed, since a detergent moving through the rear insertion pipe 620 should pass through the connection opening 561, the connection opening 561 may also be formed in the rear insertion pipe 620.

Figure 6:
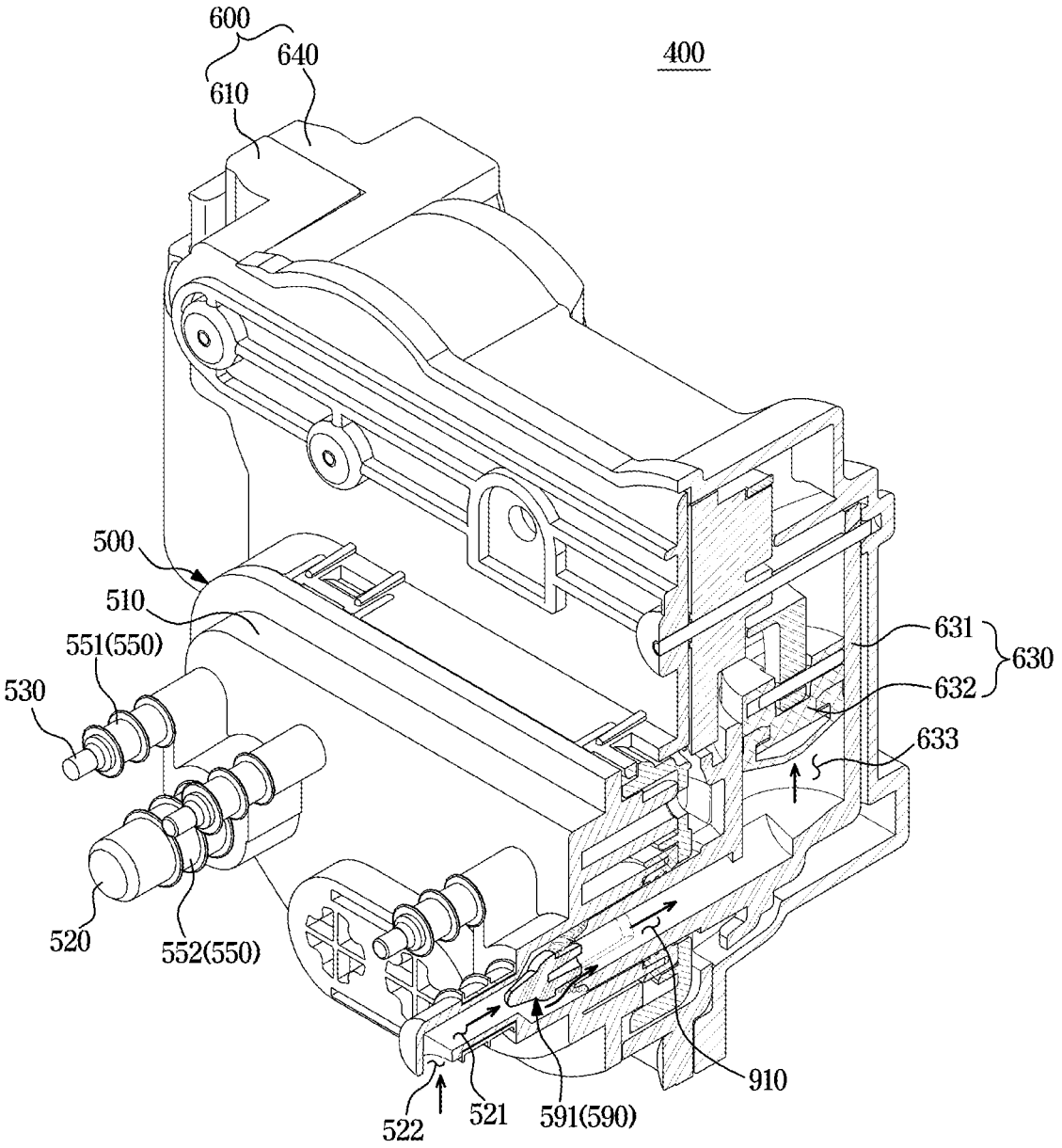
FIG. 6 is a cross-sectional perspective view of the detergent pump of FIG. 4 that is taken along line A-A' of FIG. 4.

FIG. 6 is a cross-sectional perspective view of the detergent pump 400 of FIG. 4 that is taken along line A-A' of FIG. 4.

As illustrated in FIG. 6, a detergent may flow into the detergent pump 400 through the suctioning space 521 formed in the detergent suctioner 520. Here, the detergent suction port 522 may be formed in a lower side of the front of the detergent suctioner 520.

The front insertion pipe 560 may be formed behind the detergent suctioner 520. The rear insertion pipe 620 may be inserted into and coupled to the rear of the front insertion pipe 560.

A common flow path 910 formed by the suctioning space 521 formed in the detergent suctioner 520, the front insertion pipe 560, and the rear insertion pipe 620 may be provided. The common flow path 910 may include the front common flow path 911 formed by the front insertion pipe 560 and the rear common flow path 912 formed by the rear insertion pipe 620.

A compression space 633 may be provided to be connected to the common flow path 910 behind the common flow path 910. The compression space 633 may be formed by the pumper 630 provided in the middle case 610.

The pumper 630 provided in the middle case 610 may include a cylinder 631 provided to form the compression space 633 and a piston 632 movably inserted into the cylinder 631 to discharge a detergent accommodated in the compression space 633 from the compression space 633.

Here, the cylinder 631 may have a cylindrical shape. The piston 632 may also have a shape that corresponds to the cylindrical shape.

The cylinder 631 may be formed to vertically extend, and the piston 632 may vertically move in the cylinder 631 to change the volume of the compression space 633. However, this is only an example, and aspects of the present disclosure may also apply to an example in which the cylinder 631 is formed to extend in a front-rear direction and the piston 632 is formed to extend in the front-rear direction.

However, in a case in which the cylinder 631 is formed to vertically extend, the cylinder 631 may have a smaller depth in the front-rear direction as compared to when the cylinder 631 is formed to extend in the front-rear direction. Considering that the detergent supply device 100 is formed inside the cabinet 10 (see FIG. 2), since components for various functions may be provided inside the cabinet 10, a length of the detergent supply device 100 in the front-rear direction may not be long to allow such components to be installed. However, in a case in which the cylinder 631 vertically extends, a vertical length of the detergent supply device 100 may increase. The increase in the vertical length of the detergent supply device 100 relates to the height of the washing machine 1 and may not cause a problem in terms of the arrangement relationship with the other components mentioned above. The problem in terms of the arrangement relationship with the other components is often dealt with more importantly than a problem of setting the height of the washing machine 1. Therefore, the cylinder 631 may extend vertically rather than extending in the front-rear direction.

The piston 632 may have a conical shape, in which a central portion forms a vertex, formed in a direction in which the piston 632 moves. A shape that corresponds to the conical shape may be formed at a lower side of the cylinder 631. In this way, a detergent may smoothly move upon a decrease in the volume of the compression space 633.

When the piston 632 moves upward, the volume of the compression space 633 formed inside the cylinder 631 increases. Accordingly, negative pressure is generated in the compression space 633. Here, in a case in which the detergent suctioner 520 is positioned in the detergent accommodation space 201 (see FIG. 3), and a certain amount or more of a detergent is accommodated in the detergent accommodation space 201, the detergent may flow into the detergent pump 400 through the detergent suction port 522.

Here, the first check valve module 591 may be provided between the detergent suctioner 520 and the front common flow path 911 in order to control the inflow and outflow of a detergent. In the first check valve module 591, a head portion 594 which is tapered forward to be inserted into the suctioning space 521 formed in the detergent suctioner 520 and an elastic support portion 595 which extends rearward from a rear of the head portion 594 may be provided. A hollow which extends in the front-rear direction may be formed in a central portion of the elastic support portion 595. The check valve body 593, which will be described below, should block an inlet of the suctioning space 521 to block a detergent flowing into the suctioning space 521. In this process, deformation of the check valve body 593 may occur, and the hollow may be formed to facilitate the deformation of the check valve body 593.

In other words, the first check valve module 591 may include the check valve body 593 which includes the head portion 594 configured to open or close the suctioning space 521 and the elastic support portion 595 extending from one end of the head portion 594 to be integrally formed with the head portion 594 and having a smaller cross-sectional area than the one end of the head portion 594.

The first check valve module 591 may include the elastic member 596 configured to elastically bias the check valve body 593 in a direction toward the suctioning space 521.

The check valve body 593 may move toward the compression space 633 due to the negative pressure generated in the compression space 633 when the piston 632 moves upward. Accordingly, the check valve body 593 may not block a portion between the suctioning space 521 and the common flow path 910.

A detergent flown into the suctioning space 521 through the detergent suction port 522 may move to the common flow path 910 connected to the suctioning space 521. The detergent which has moved to the common flow path 910 may move to the compression space 633.

A flow path along which a detergent moves from the suctioning space 521 to the compression space 633 may be referred to as a detergent inflow path.

FIG. 7 is a cross-sectional perspective view illustrating a process in which a detergent flown into the detergent pump 400 of FIG. 6 flows out.

As illustrated in FIG. 7, when the piston 632 moves to the lower side of the cylinder 631, a detergent may move to an outside of the detergent pump 400.

When the piston 632 moves to the lower side of the cylinder 631, pressure of the detergent accommodated in the compression space 633 increases. Since pressure of the detergent is higher in the compression space 633 than at the outside of the detergent pump 400, the detergent may move to the outside of the detergent pump 400.

Here, the check valve body 593 provided between the suctioning space 521 and the common flow path 910 moves toward the suctioning space 521 due to a detergent which has flown out of the compression space 633. In this way, the check valve body 593 prevents movement of the detergent toward the suctioning space 521.

The detergent which has flown out of the compression space 633 may move through the common flow path 910. In other words, the common flow path 910 is a flow path along which a detergent moves when the detergent flows into the compression space 633 and is also a passage along which the detergent moves when the detergent flows out of the compression space 633.

As will be described below, different from the present disclosure, a detergent may not pass through the same flow path during the inflow and outflow. In this case, the detergent discharger 540 should extend in a direction different from a direction in which the detergent suctioner 520 extends. For example, in a case in which the detergent discharger 540 is formed to extend rearward, a detergent can be mixed with washing water flowing in the mixing chamber 141 and move toward the tub 20 only when accommodated in the mixing chamber 141 formed in the housing 140, and thus a flexible pipe which connects from an inlet of the detergent discharger 540 to the housing 140 is further needed.

Figure 8:
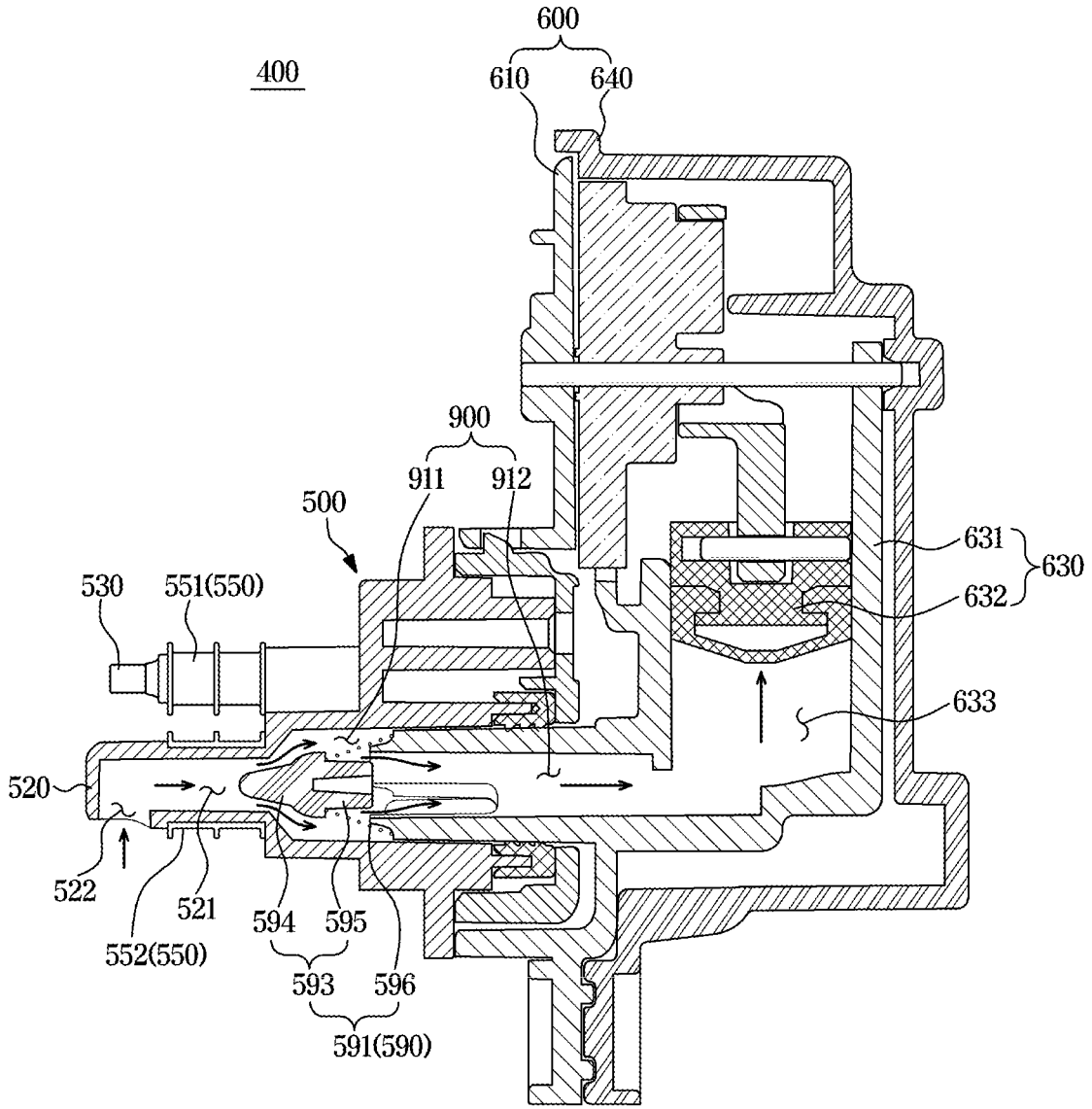
FIG. 8 is a cross-sectional view of the detergent pump of FIG. 4 that is taken along line A-A' of FIG. 4.
Figure 9:
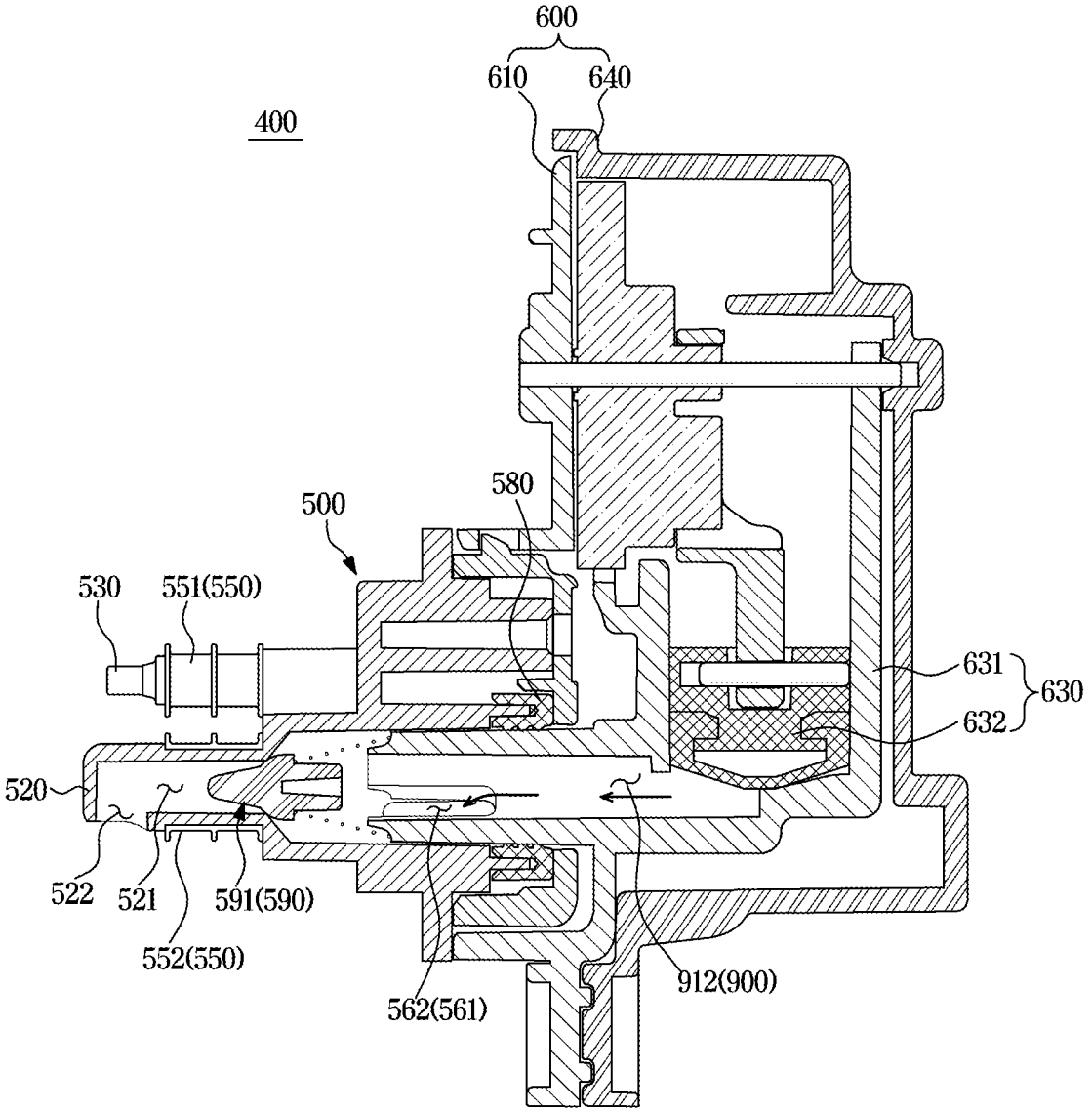
FIG. 9 is a cross-sectional view illustrating a detergent flown into the detergent pump of FIG. 8 moving toward a connection opening.

FIG. 8 is a cross-sectional view of the detergent pump 400 of FIG. 4 that is taken along line A-A' of FIG. 4. FIG. 9 is a cross-sectional view illustrating a detergent flown into the detergent pump 400 of FIG. 8 moving toward the connection opening 561.

As illustrated in FIGS. 8 and 9, the first check valve module 591 may move back and forth according to movement of the piston 632.

As illustrated in FIG. 8, when the piston 632 moves upward, pressure in the compression space 633 becomes lower than pressure in other spaces. In this way, a force of sucking toward the compression space 633 is generated. In this way, the check valve body 593, which is elastically biased toward the suctioning space 521 due to the elastic member 596 at ordinary times, may more rearward. When the check valve body 593 moves rearward, the suctioning space 521 and the common flow path 910 communicate with each other.

The force of sucking toward the compression space 633 may suck in a detergent in addition to the check valve body 593. The detergent may move to the suctioning space 521 formed in the detergent suctioner 520 and move to the compression space 633 through the common flow path 910.

Then, as illustrated in FIG. 9, when the piston 632 moves downward, pressure in the compression space 633 becomes higher than pressure in other spaces. In this way, a force of pushing a detergent to an outside of the compression space 633 is generated. In this way, the check valve body 593, which has moved rearward, moves forward again and blocks the portion between the suctioning space 521 and the common flow path 910.

A detergent may move toward the connection opening 561 through the common flow path 910 in the compression space 633. In particular, the connection opening 561 may be formed in a front end portion of the rear common flow path 912. In a case in which the connection opening 561 formed in the front insertion pipe 560 is not formed in the foremost portion of the front insertion pipe 560, a detergent passing through a portion of the front common flow path 911, which is formed in the front insertion pipe 560, that is formed at a front of the connection opening 561 may be reflected at the front and move toward the connection opening 561 again.

The detergent which has moved toward the connection opening 561 may move toward the connection flow path 920.

Since the discharging space 541 formed in the detergent discharger 540, which extends forward, is connected to an end of the connection flow path 920, the detergent discharger 540 may be seen as being provided at a lower side of the center of the cases 500 and 600.

As mentioned above, the connection flow path 920 may be formed by the connection partition 570 and the flow path sealing member 580.

Figure 10:
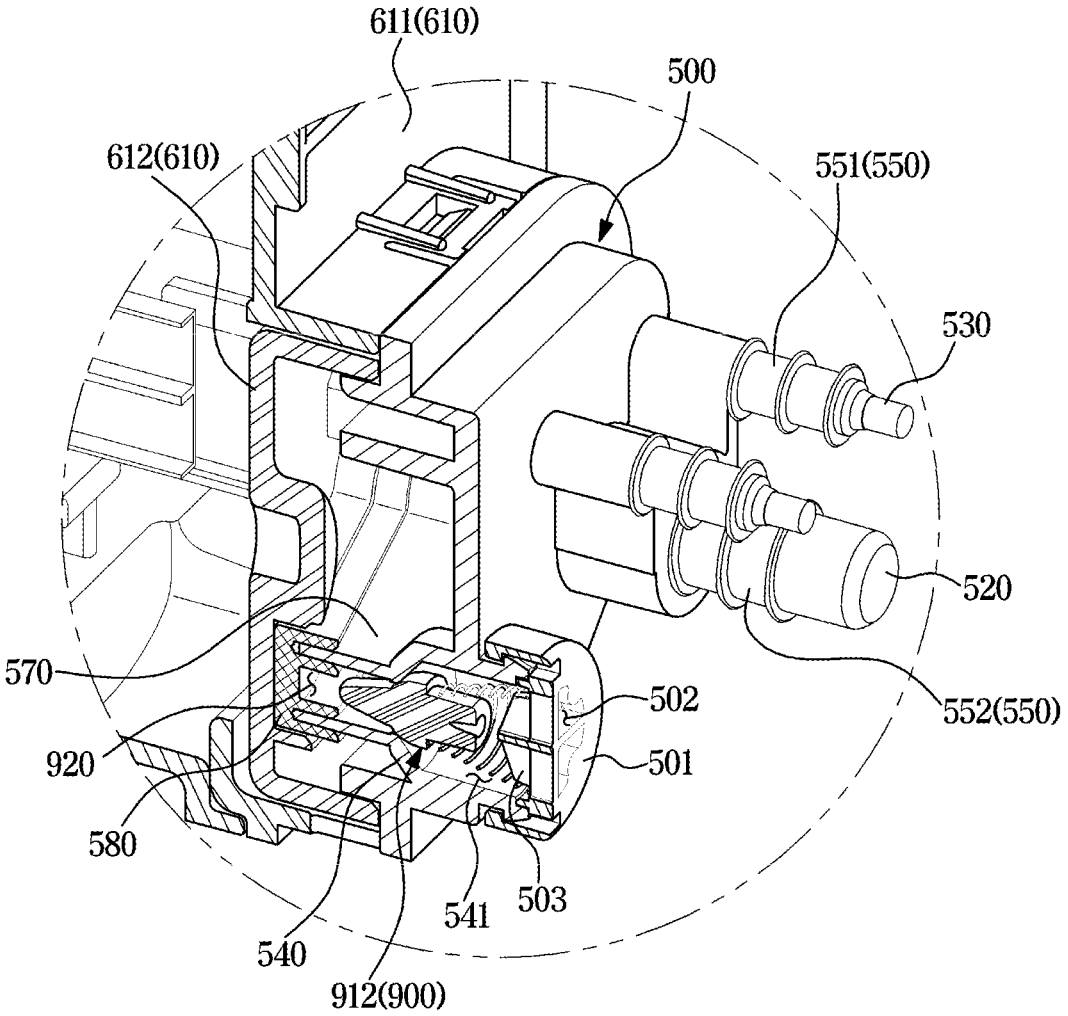
FIG. 10 is a cross-sectional perspective view of the detergent pump of FIG. 4 that is taken along line B-B' of FIG. 4.
Figure 11:
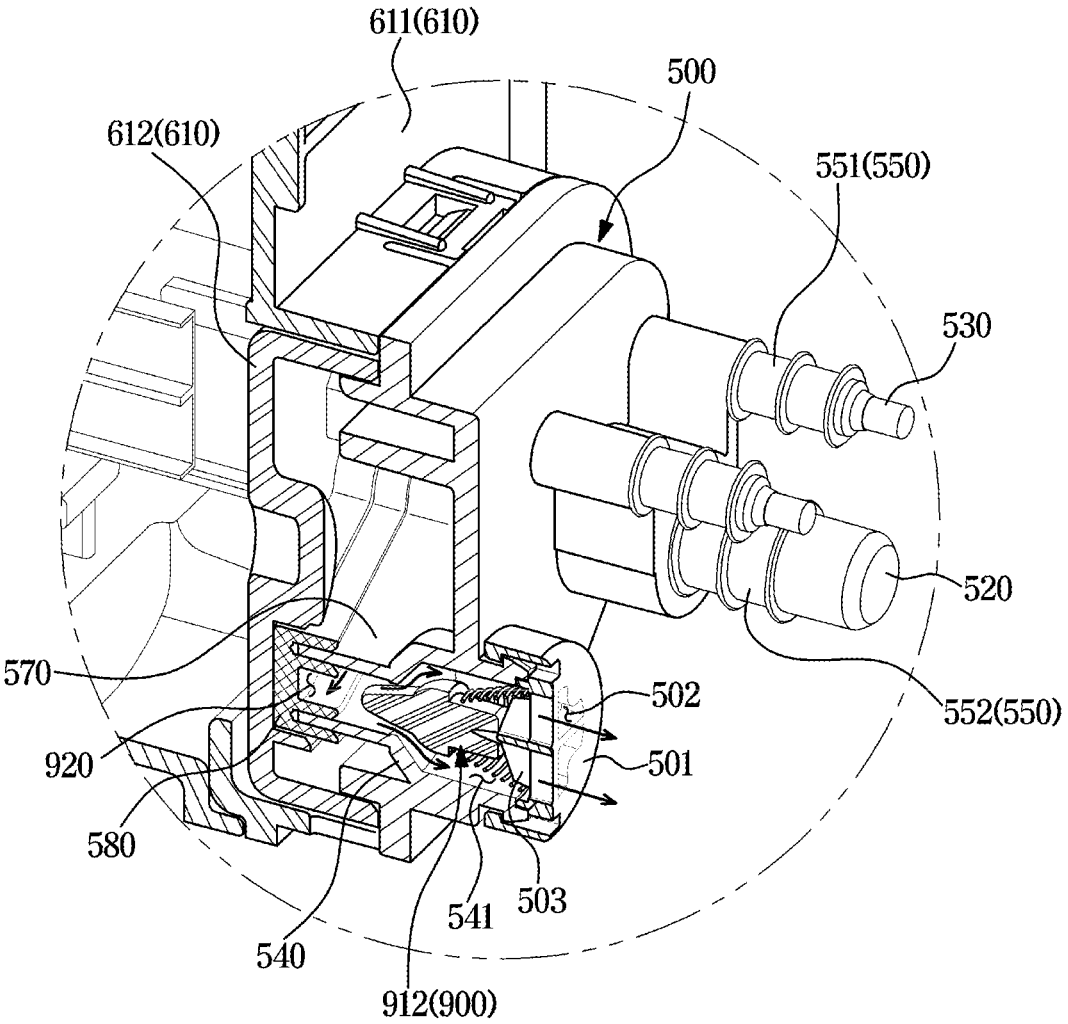
FIG. 11 is a cross-sectional perspective view illustrating a detergent flown into the detergent pump of FIG. 10 flowing out through a detergent outflow pipe.

FIG. 10 is a cross-sectional perspective view of the detergent pump 400 of FIG. 4 that is taken along line B-B' of FIG. 4. FIG. 11 is a cross-sectional perspective view illustrating a detergent flown into the detergent pump 400 of FIG. 10 flowing out through the detergent discharger 540.

As illustrated in FIG. 10, discharge of a detergent to an outside of the detergent discharger 540 may be controlled by the second check valve module 592 installed near the detergent discharger 540. The check valve body 593 may be elastically biased toward the connection flow path 920 due to the elastic member 596. A site where the connection flow path 920 and the discharging space 541 are connected to each other may be blocked by the check valve body 593.

As illustrated in FIG. 11, a detergent may flow into the connection flow path 920 due to the piston 632 moving downward, and in this way, the check valve body 593 may move forward. Therefore, the connection flow path 920 and the discharging space 541 formed in the detergent discharger 540 may be connected to each other. In this way, the detergent may move toward the mixing chamber 141.

Figure 12:
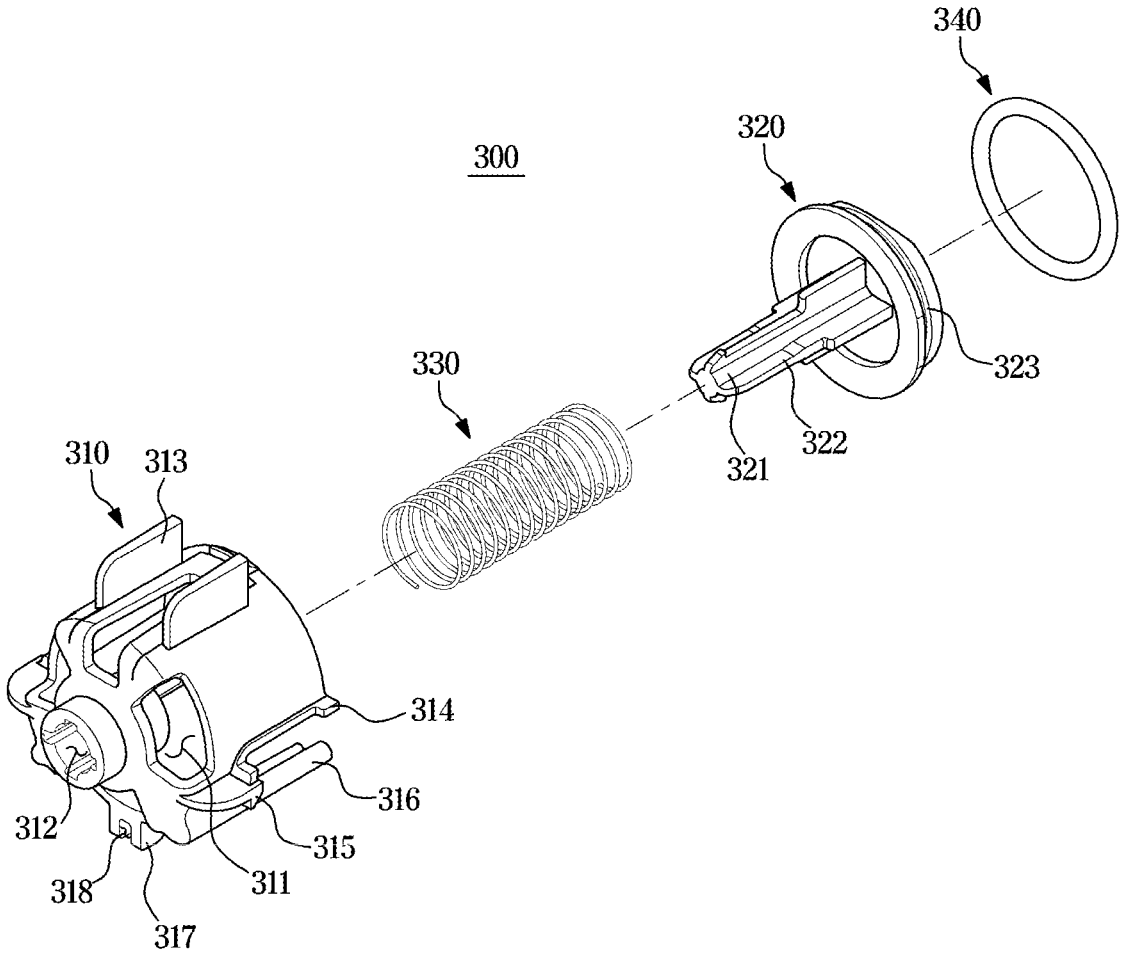
FIG. 12 is an exploded view of a detergent compartment valve module of FIG. 3.
Figure 13:
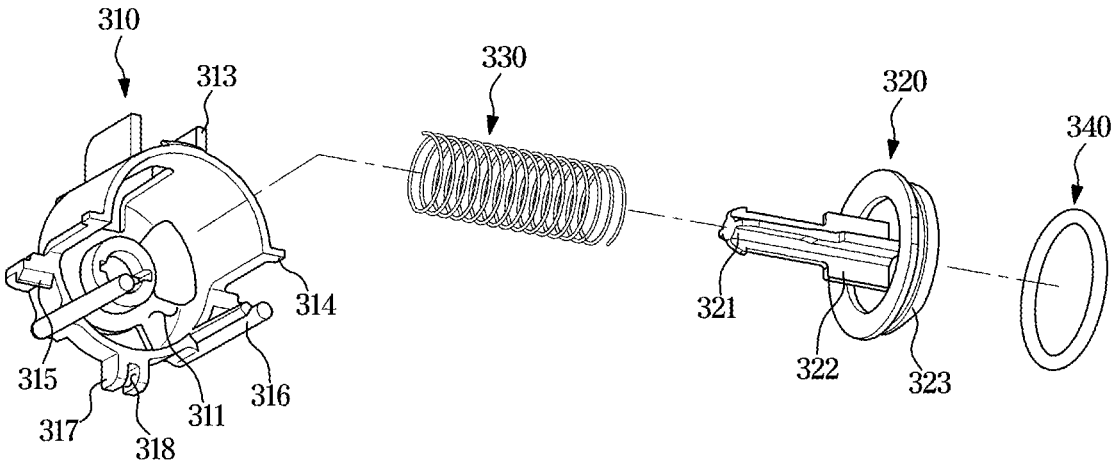
FIG. 13 is a rear exploded view of the detergent compartment valve module of FIG. 12.

FIG. 12 is an exploded view of the detergent compartment valve module 300 of FIG. 3. FIG. 13 is a rear exploded view of the detergent compartment valve module 300 of FIG. 12.

As illustrated in FIGS. 12 and 13, the detergent compartment valve module 300 may include a valve case 310 which forms an exterior and has a valve case hole 311 formed therein to allow a detergent to flow in.

A detergent compartment valve 320 provided to open or close the plurality of detergent container holes 220 may be provided at a rear of the valve case 310.

The plurality of detergent container holes 220 may include the first detergent container hole 221 into which the detergent suctioner 520 may be inserted and the second detergent container hole 222 into which the detecting member 530 may be inserted. Therefore, in order to control an outflow of a detergent through the first detergent container hole 221 and the second detergent container hole 222, the detergent compartment valve 320 may move to a front of the detergent accommodation space 201 and simultaneously open or close the first detergent container hole 221 and the second detergent container hole 222.

The detergent compartment valve 320 may cover the plurality of detergent container holes 220 and may have a pressing portion 323 formed to be pressed by the detergent suctioner 520. The detergent compartment valve 320 may include the fixing member 603 which protrudes to extend by passing through a front center of the valve case 310 from a center of the pressing portion 323.

The fixer 505 may be formed on the front center of the valve case 310. The fixing member 603 may be provided to pass through the fixer 505 formed in the valve case 310. The fixer 505 may be provided corresponding to a cross-sectional shape of the fixing member 603.

The fixing member 603 may include a guide rib 322 provided in a radial direction of the fixing member 603 to prevent rotation of the detergent compartment valve 320.

The detergent compartment valve module 300 may include a valve elastic member 330 configured to be elastically biased rearward by the detergent compartment valve 320. The elastic member 596 may be provided to surround the fixing member 603 and may press each of a rear surface of the valve case 310 and a front surface of the pressing portion 323 of the detergent compartment valve 320.

The detergent compartment valve module 300 may include a valve sealing member 340 which is coupled to correspond to a rear edge of the detergent compartment valve 320 and provided to seal between the detergent compartment valve 320 and the plurality of detergent container holes 220.

The valve sealing member 340 may perform a sealing function by coming in contact with a valve guide surface 231 which is provided to correspond to the plurality of detergent container holes 220 which will be described below.

The detergent suctioner 520 may not press the center of the pressing portion 323 of the detergent compartment valve 320. In particular, since it is desirable for the detergent suctioner 520 to be formed close to the lower side of the detergent container 200, in this case, the detergent suctioner 520 may not be formed corresponding to the center of the pressing portion 323 of the detergent compartment valve 320.

There is a need to guide the detergent compartment valve 320 for the detergent compartment valve 320 to horizontally move forward due to being pressed by the detergent suctioner 520 so that sealing between the detergent compartment valve 320 and the plurality of detergent container holes 220 is released.

To this end, the fixing member 603 which extends forward may be formed on the detergent compartment valve 320, and the fixer 505 into which the fixing member 603 can be inserted may be provided at the center of the valve case 310 to guide the fixing member 603.

Here, in addition, an exterior of the valve case 310 may extend toward the pressing portion 323 while having a shape that surrounds the shape of an edge of the pressing portion 323 of the detergent compartment valve 320. In other words, the pressing portion 323 may move forward along an inner side of a surface of the valve case 310 that is formed at a side. For example, in a case in which the pressing portion 323 has a disk shape, the valve case 310 may have the shape of the cylinder 631, and the pressing portion 323 may be guided to an inside of the shape of the cylinder 631 and move forward.

Since the valve case 310 may also move as the detergent compartment valve 320 moves, there is a need to guide or limit the movement of the valve case 310. To this end, a top guide 313 which extends upward may be provided on an upper side of the valve case 310.

A guide wing 315 which is provided to allow the valve case 310 to be accurately positioned in front of the plurality of detergent container holes 220 formed in the rear of the detergent container 200 and which has an inclined surface on one side may be provided on a side of the valve case 310.

An anti-rotation rib 314 which extends sideward to prevent rotation when the valve case 310 is coupled to a front of the plurality of detergent container holes 220 formed in the rear of the detergent container 200 may be formed on a side of the valve case 310.

The valve case 310 may include an insertion protrusion 316 which extends rearward.

The valve case 310 may include a pair of fitting guide ribs 317 which extend downward from a lower side of the valve case 310. A groove for a fitting rib 260 may be formed between the pair of fitting guide ribs 317.

The above configuration of the valve case 310 is for, when coupling to a rear of an inner side of the detergent container 200, guide the coupling. Hereinafter, coupling between the detergent container 200 and the valve case 310 or the detergent compartment valve module 300 will be described in more detail.

Figure 14:
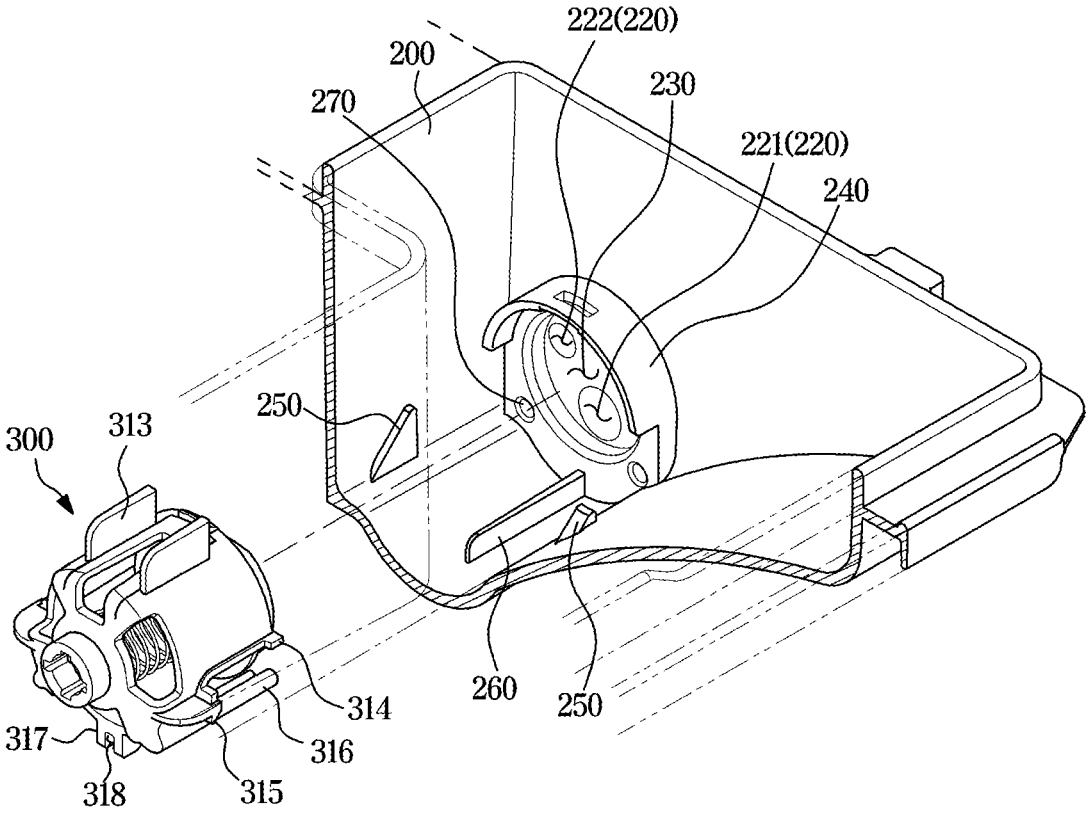
FIG. 14 is an exploded view illustrating the detergent compartment valve module of FIG. 3 being coupled to a rear of a detergent container.

FIG. 14 is an exploded view illustrating the detergent compartment valve module 300 of FIG. 3 being coupled to the rear of the detergent container 200. FIG. 15 is a front view of the detergent compartment valve module 300 of FIG. 14 coupled to the rear of the detergent container 200.

As illustrated in FIGS. 14 and 15, the detergent compartment valve module 300 may be coupled to the detergent container 200 at the rear of the inner side of the detergent container 200. The detergent compartment valve module 300 may be provided at a position corresponding to the plurality of detergent container holes 220.

The detergent container 200 may include a support portion 250 for the guide wing 315 that has an inclined surface corresponding to the inclined surface formed on the guide wing 315 of the valve case 310. Movement of the valve case 310 to a desired position may be guided by the support portion 250 for the guide wing 315.

The detergent container 200 may include the fitting rib 260 which extends forward to be inserted into the groove for the fitting rib 260 and which protrudes upward. In this way, the valve case 310 may be guided to a desired position in the detergent container 200.

For the insertion protrusion 316 of the valve case 310 to be inserted, an insertion protrusion hole 270 may be provided in a position in the detergent container 200 where the valve case 310 is coupled. By the insertion protrusion 316 being inserted into the insertion protrusion hole 270, movement of the valve case 310 can be limited.

A valve sealing recess 230 configured to retreat rearward may be formed in a position in the detergent container 200 that corresponds to the plurality of detergent container holes 220. In other words, the plurality of detergent container holes 220 may be provided in a rear of the valve sealing recess 230. The valve guide surface 231, which is an outer side of the valve sealing recess 230, may be provided to correspond to an edge of the detergent compartment valve 320. When the detergent compartment valve 320 retreats rearward, the valve sealing member 340 may be positioned between the valve guide surface 231 and the rear edge of the detergent compartment valve 320 and prevent leakage of a detergent, which is provided in the detergent container 200, through the plurality of detergent container holes 220.

An anti-rotation flange 240 which surrounds the valve sealing recess 230 and protrudes forward may be provided. The anti-rotation flange 240 may extend in a circumferential direction to a position corresponding to the anti-rotation rib 314 of the valve case 310 at an upper side. When the valve case 310 is coupled to the detergent container 200, an end of the anti-rotation flange 240 is provided adjacent to the anti-rotation rib 314, and when the valve case 310 is about to rotate, the valve case 310 may come in contact with the end of the anti-rotation flange 240 and thus rotation of the valve case 310 can be prevented. In particular, when the anti-rotation rib 314 is formed on both sides of the valve case 310, rotation of the valve case 310 can be prevented in either direction.

In other words, the detergent container 200 may include the anti-rotation flange 240 which may be formed adjacent to one side of the anti-rotation rib 314 to prevent rotation of the anti-rotation rib 314.

The top guide 313 may be provided to correspond to a position at which the anti-rotation flange 240 protrudes forward. When coupled to the detergent container 200 of the valve case 310, the top guide 313 may extend rearward to a position at which the top guide 313 comes in contact with the anti-rotation flange 240 and may extend upward so that rearward movement of the valve case 310 is prevented by the anti-rotation flange 240. In other words, when the valve case 310 is about to move rearward, the rearward movement of the valve case 310 can be prevented by a rear surface of the top guide 313 coming in contact with a front surface of the anti-rotation flange 240.

Figure 16:
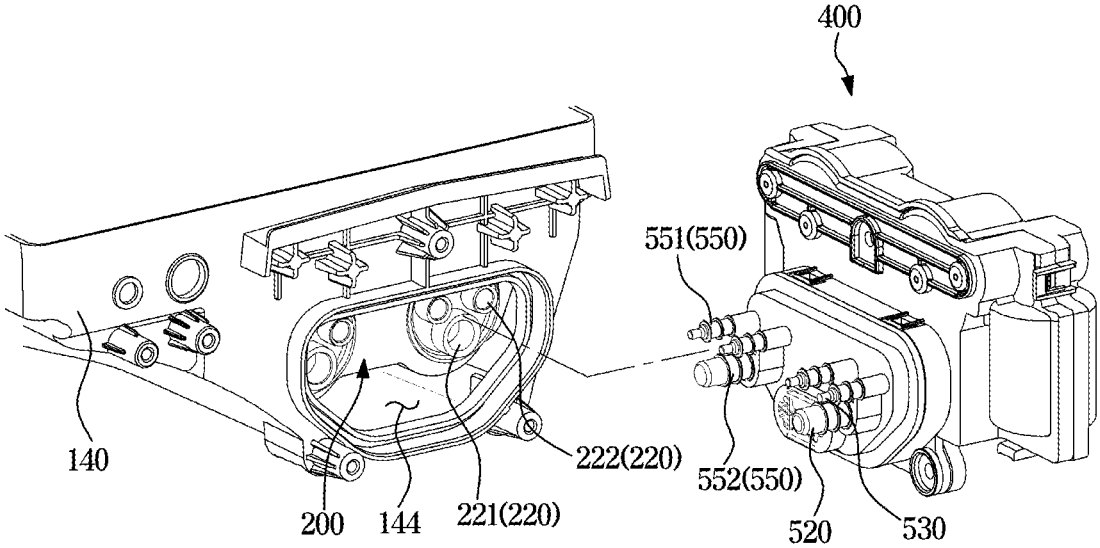
FIG. 16 is an exploded view of a detergent container, a housing, and a detergent pump of FIG. 3.

FIG. 16 is an exploded view of the detergent container 200, the housing 140, and the detergent pump 400 of FIG. 3.

As illustrated in FIG. 16, the detergent pump 400 may be coupled to the detergent container 200.

The detergent container 200 may be positioned inside the housing 140. A pump opening 144 provided to correspond to the shape of the front case 500 of the detergent pump 400 may be formed in the rear of the housing 140.

The detecting member 530 protruding forward and the detergent suctioner 520 protruding forward may be formed on a front of the detergent pump 400. The detergent pump 400 may include a first hole sealing member 551 provided to surround the detergent suctioner 520 and a second hole sealing member 552 provided to surround the detecting member 530.

The first detergent container hole 221 formed at a position corresponding to the detergent suctioner 520 so that the detection suctioner 520 is able to be inserted thereinto may be formed in the rear of the detergent container 200. Also, the second detergent container hole 222 formed at a position corresponding to the detecting member 530 so that the detecting member 530 is able to be inserted thereinto may be formed.

Hereinafter, a process in which the detergent pump 400 is docked at the detergent container 200 will be described in detail.

Figure 17:
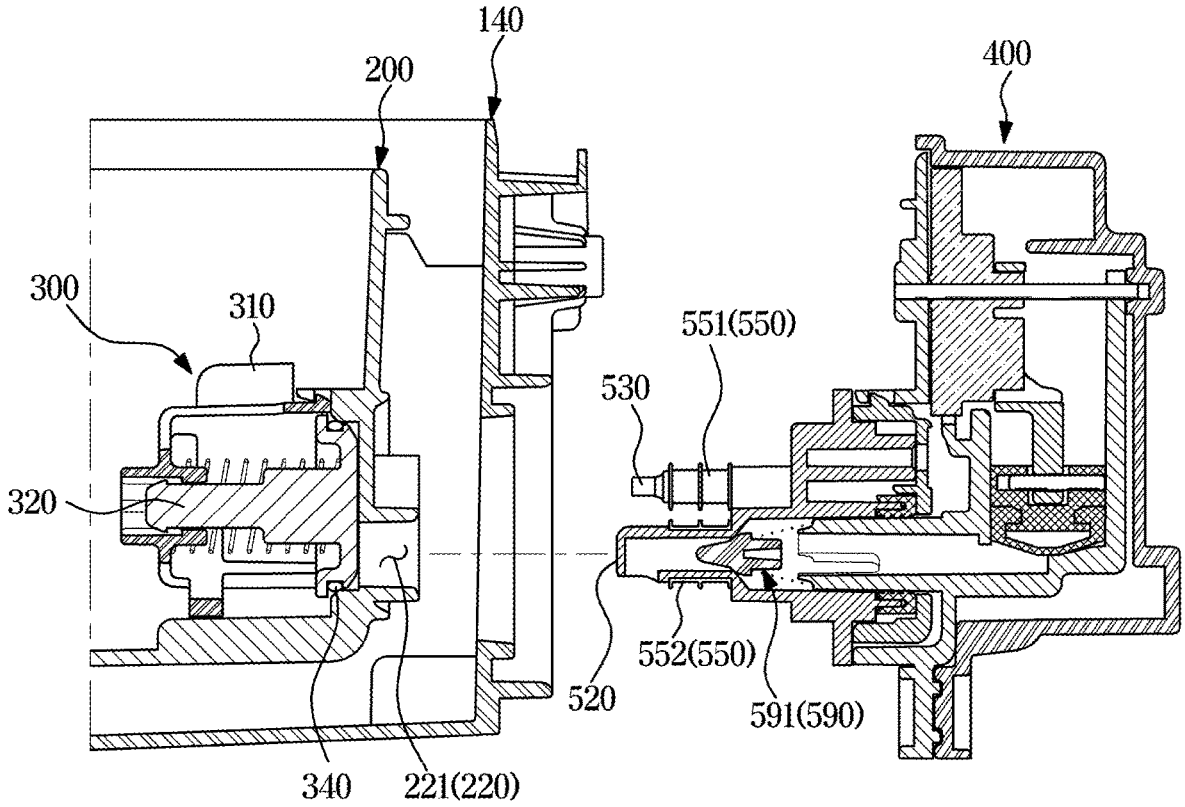
FIG. 17 is a cross-sectional view of a state before the detergent pump is coupled to the detergent container of FIG. 3.
Figure 18:
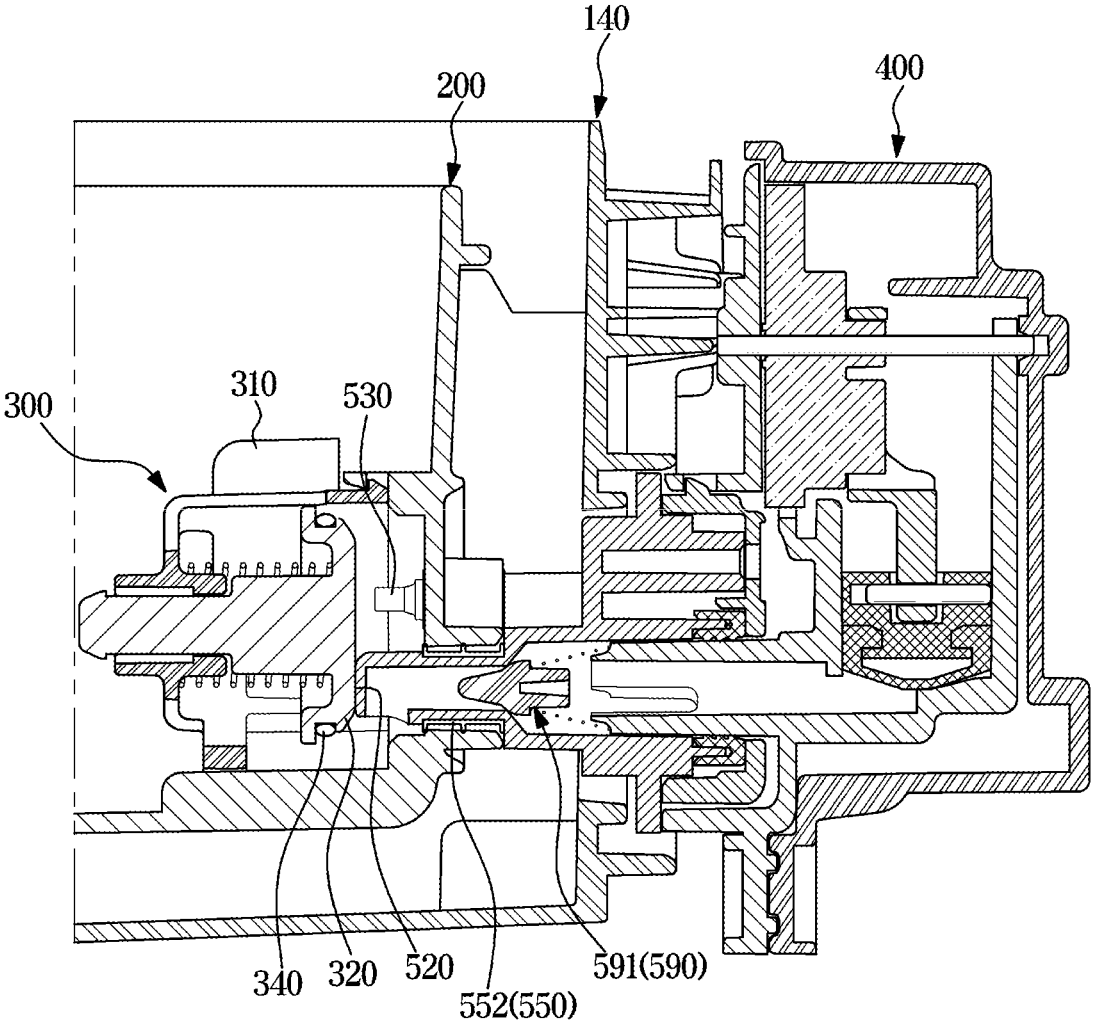
FIG. 18 is a cross-sectional view of a state in which the detergent pump of FIG. 17 is coupled to the detergent container.
Figure 19:
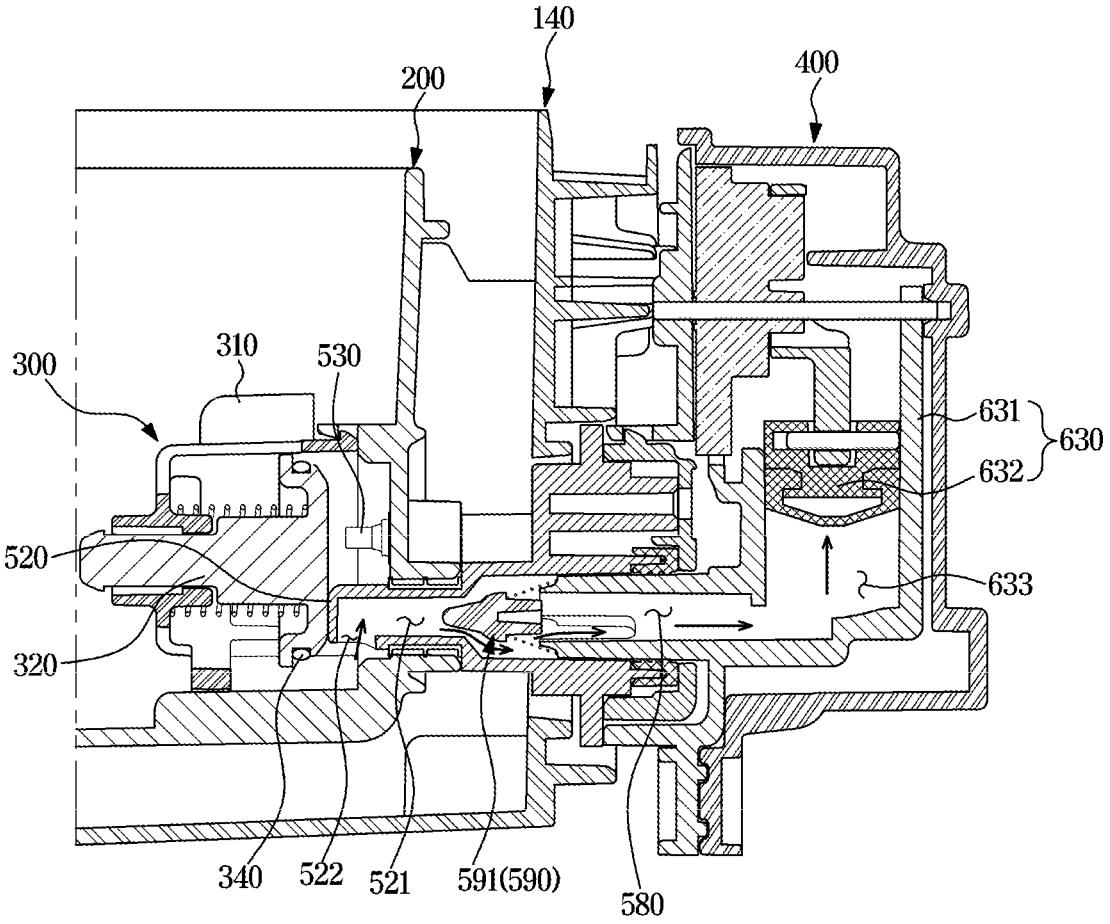
FIG. 19 is a cross-sectional view illustrating a detergent flowing into the detergent pump of FIG. 18.

FIG. 17 is a cross-sectional view of a state before the detergent pump 400 is coupled to the detergent container 200 of FIG. 3. FIG. 18 is a cross-sectional view of a state in which the detergent pump 400 of FIG. 17 is coupled to the detergent container 200. FIG. 19 is a cross-sectional view illustrating a detergent flowing into the detergent pump 400 of FIG. 18.

As illustrated in FIG. 17, the detergent pump 400 may horizontally move toward the detergent container 200.

Here, the detergent suctioner 520 may move toward the first detergent container hole 221, and the detecting member 530 may move toward the second detergent container hole 222.

Before the detergent pump 400 is docked at the detergent container 200, the detergent compartment valve 320 of the detergent compartment valve module 300 may receive an elastic force by the valve elastic member 330 in a direction in which the plurality of detergent container holes 220 are sealed. In this way, a detergent in the detergent accommodation space 201 does not flow out through the plurality of detergent container holes 220.

As illustrated in FIG. 18, when the detergent pump 400 is docked at the detergent container 200, the detergent suctioner 520 and the detecting member 530 that the detergent pump 400 includes may enter the detergent container 200.

In other words, when the detergent compartment valve 320 is pressed and moved, the detecting member 530 may be positioned in the detergent accommodation space 201.

Here, the detergent suction port 522 formed in the detergent suctioner 520 may be positioned in the detergent accommodation space 201 formed in the detergent container 200. In this way, a detergent placed in the detergent accommodation space 201 may enter the detergent pump 400 through the detergent suction port 522.

Here, the detecting member 530 may be positioned in the detergent accommodation space 201. The detecting member 530 may come in contact with the detergent in the detergent accommodation space 201 to measure the amount of detergent.

When the detergent suctioner 520 presses the detergent compartment valve 320 forward, the detergent compartment valve 320 moves forward.

The detergent suctioner 520 may be disposed to press the detergent compartment valve 320 forward so that sealing between the plurality of detergent container holes 220 and the detergent compartment valve 320 by the valve sealing member 340 is released.

In response to the detergent suctioner 520 pressing the detergent compartment valve 320 and sealing between the plurality of detergent container holes 220 and the detergent compartment valve 320 being released while the detergent pump 400 is being docked at the detergent container 200, simultaneously, the first hole sealing member 551 may seal the first detergent container hole 221, and the second hole sealing member 552 may seal the second detergent container hole 222 so that leakage of a detergent to the outside of the detergent container 200 is prevented.

In other words, the second hole sealing member 552 may seal the second detergent container hole 222 when the first detergent container hole 221 is sealed by the first hole sealing member 551.

As illustrated in FIG. 19, in a case in which docking of the detergent pump 400 at the detergent container 200 is completed, the cylinder 631 of the detergent pump 400 may move upward to suction a detergent into the compression space 633. Then, as described above, the detergent flows into the detergent suctioner 520, flows out through the detergent discharger 540, and moves to the mixing chamber 141 in the housing 140.

Although not illustrated, the detergent pump 400 may be undocked from the detergent container 200. In a case in which the detergent pump 400 is undocked, the hole sealing member 550 may retreat rearward from the plurality of detergent container holes 220 and sealing at the plurality of detergent container holes 220 may be unsealed. However, since the detergent compartment valve 320 moves rearward due to the valve elastic member 330 and seals between the plurality of detergent container holes 220 and the detergent container 200 in front of the plurality of detergent container holes 220, a detergent may not leak.

In the case in which the detergent pump 400 is undocked, a detergent may remain in the detergent suctioner 520. In this case, since pressure of a detergent near the detergent suction port 522 is maintained to be identical to air pressure, the detergent does not leak to an outside of the detergent suctioner 520.

In this way, leakage of a detergent is prevented even when the detergent pump 400 is undocked from the detergent container 200.

Figure 20:
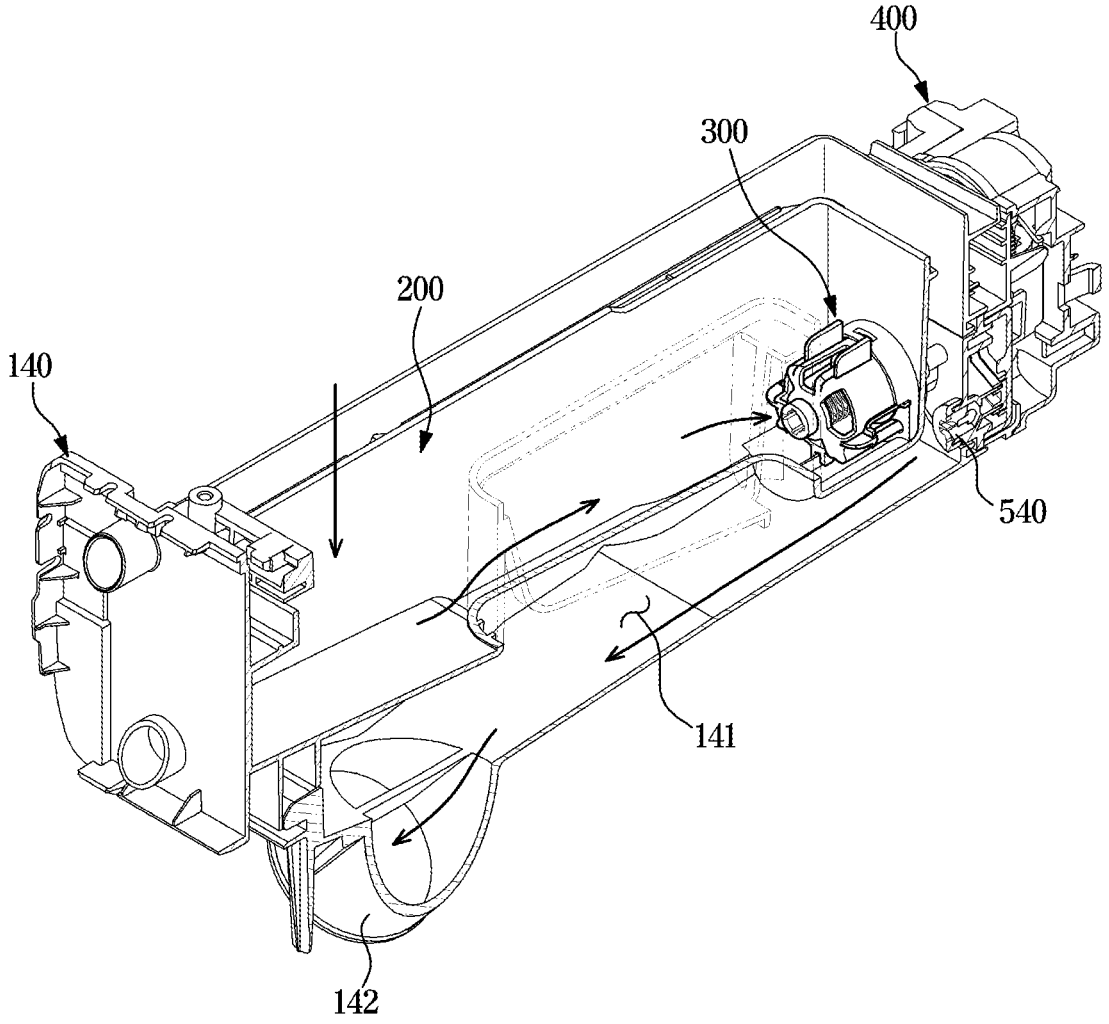
FIG. 20 is a cross-sectional view of the detergent supply device of FIG. 3.

FIG. 20 is a cross-sectional view of the detergent supply device 100 of FIG. 3.

As illustrated in FIG. 20, when accommodated in the detergent accommodation space 201, a detergent may move rearward and move into the detergent pump 400. The detergent which has moved into the detergent pump 400 may move to the mixing chamber 141 through the detergent discharger 540 through the above-described process. Since washing water is flowing toward the outlet 142 in the mixing chamber 141, the detergent which has moved to the mixing chamber 141 may be mixed with the washing water and move toward the outlet 142. The moved detergent may move into the tub 20 through the outlet 142.

Figure 21:
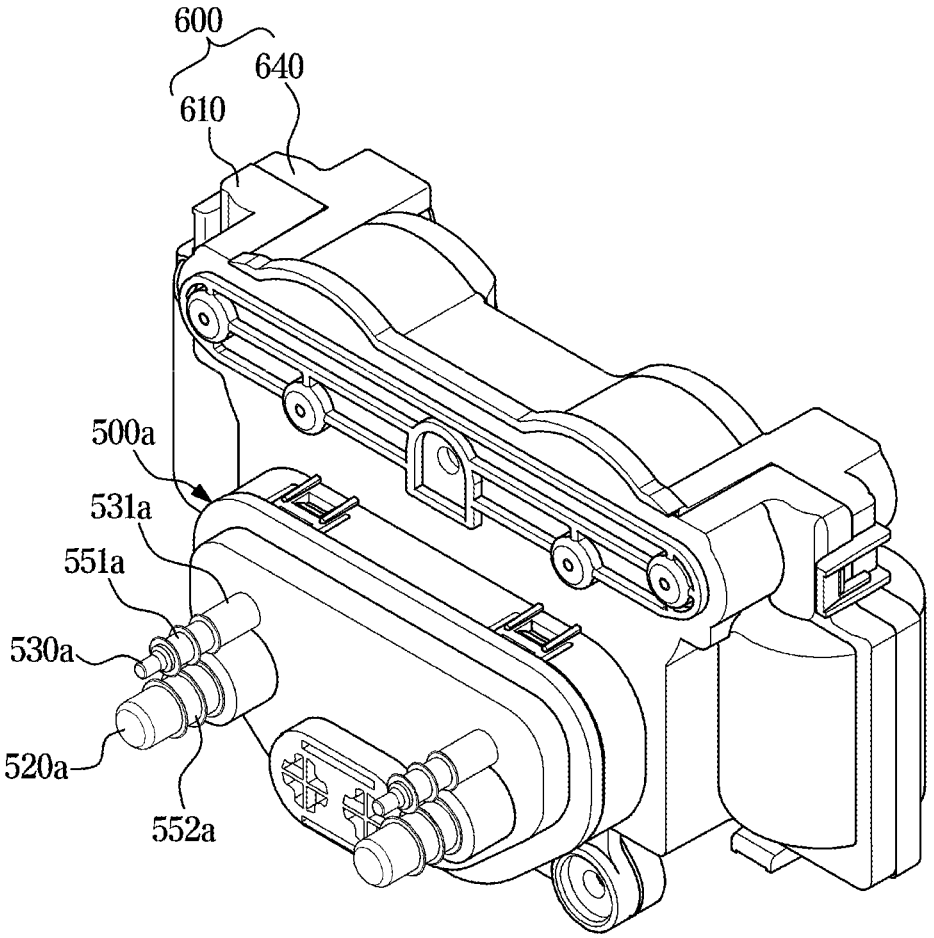
FIG. 21 is a perspective view of a detergent pump according to one embodiment of the present disclosure.

FIG. 21 is a perspective view of a detergent pump **400*a*** according to one embodiment of the present disclosure.

As illustrated in FIG. 21, a detecting member **530*a* may be provided as a single detecting member 530*a*. In this case, a second detergent container hole (not illustrated) which corresponds to the detecting member 530***a* may also be formed as a single second detergent container hole (not illustrated).

According to one aspect of the present disclosure, a detergent supply device of a washing machine includes a detecting member which extends forward and is able to be positioned inside a detergent container. In this way, the amount of detergent in the detergent container can be accurately recognized.

According to one aspect of the present disclosure, a detergent supply device of a washing machine includes a detergent inflow pipe which extends forward and is able to be positioned inside a detergent container and includes a hole sealing member configured to surround the detergent inflow pipe. In this way, leakage of a detergent can be prevented by the detergent container and a detergent pump being separated from each other.

Specific embodiments illustrated in the drawings have been described above. However, the present disclosure is not limited to the embodiments described above, and those of ordinary skill in the art to which the disclosure pertains may make various changes thereto without departing from the gist of the technical spirit of the disclosure defined in the claims below.

What is claimed is:

1. A washing machine comprising:

a cabinet;

a drum inside the cabinet, the drum having a washing chamber therein; and a detergent supply device configured to supply a detergent to the washing chamber, the detergent supply device including:

a detergent container having a detergent accommodation space therein to accommodate the detergent to be supplied and a detergent container hole; and a detergent pump detachably coupled to the detergent container, the detergent pump to pump the detergent accommodated in the detergent accommodation space, the detergent pump including:

a detector to detect an amount of the detergent accommodated in the detergent accommodation space, the detector extending forward to be inserted into the detergent accommodation space through the detergent container hole, wherein in response to coupling the detergent pump to the detergent container, the detector passes through the detergent container hole and is accommodated in the detergent accommodation space.

2. The washing machine of claim 1, wherein the detergent pump further includes a detergent suctioner to suction the detergent accommodated in the detergent accommodation space into the detergent pump, and the detergent pump extends forward to be inserted into the detergent accommodation space.

3. The washing machine of claim 2, wherein:

the detergent container has a plurality of detergent container holes in a rear side of the detergent container; and the plurality of detergent container holes includes:

a first detergent container hole to correspond to the detergent suctioner so that the detergent suctioner passes through the first detergent container hole and is accommodated in the detergent accommodation space; and the detergent container hole, into which the detector is inserted, is a second detergent container hole to be apart from the first detergent container hole and corresponds to the detector so that the detector passes through the second detergent container hole and is accommodated in the detergent accommodation space.

4. The washing machine of claim 3, wherein:

the detergent supply device further includes a detergent compartment valve module configured to control an inflow of the detergent from inside the detergent accommodation space into the detergent pump; and the detergent compartment valve module includes:

a valve case having a valve case hole therein to allow the detergent accommodated in the detergent accommodation space to flow into the valve case hole; and a detergent compartment valve movable to a front of the detergent accommodation space and simultaneously open or close the first detergent container hole and the second detergent container hole to control an outflow of the detergent accommodated in the detergent accommodation space through the first detergent container hole and the second detergent container hole.

5. The washing machine of claim 4, wherein:

the detergent container further has a valve sealing recess therein, the detergent container corresponding to a shape of a rear side of the detergent compartment valve to receive the detergent compartment valve therein; and the detergent compartment valve module further includes a valve sealer corresponding to a rear edge of the detergent compartment valve to seal between the detergent compartment valve and the valve sealing recess.

6. The washing machine of claim 5, wherein:

the detergent suctioner is configured to press the detergent compartment valve forward so that sealing between the plurality of detergent container holes and the detergent compartment valve by the valve sealer is released; and a detergent suction port defined to allow the detergent accommodated in the detergent accommodation space to flow into the detergent suctioner, and the detergent suction port is defined in a side of the detergent suctioner.

7. The washing machine of claim 6, wherein, while the detergent compartment valve is pressed and moved, the detector is positioned inside the detergent accommodation space.

8. The washing machine of claim 7, wherein the detergent pump further includes: a first hole sealer positioned to surround an outer side of the detergent suctioner and configured to seal the first detergent container hole so that the detergent is prevented from leaking to an outside of the detergent suctioner while the detergent pump is docked at the detergent container; and a second hole sealer that surrounds an outer side of the detector configured to seal the second detergent container hole while the first detergent container hole is sealed by the first hole sealer so that the detergent is prevented from leaking to an outside of the detector.

9. The washing machine of claim 8, wherein, in response to pressing the detergent compartment valve by the detergent suctioner and opening the plurality of detergent container holes while the detergent pump is docked at the detergent container, the first hole sealer and the second hole sealer simultaneously seal the first detergent container hole and the second detergent container hole, respectively to prevent the detergent from leaking to the outside of the detergent container.

10. The washing machine of claim 7, wherein:

the detector is positioned on an upper side of the detergent suctioner; and the detergent suction port is defined in a lower side of the detergent suctioner to be spaced apart from the detector.

11. The washing machine of claim 1, wherein an end of the detector is positioned toward a front so that an amount of detergent remaining on the detector is reduced.

12. The washing machine of claim 7, wherein a diameter of the detergent suction port is less than or equal to a distance at which the detergent suction port is spaced apart from a lower end of the detergent container.

13. The washing machine of claim 3, wherein the detector includes a pair of electrodes disposed adjacent to each other at left and right sides, respectively.

14. The washing machine of claim 13, wherein the detergent suctioner is positioned between the pair of electrodes and below the pair of electrodes.

15. The washing machine of claim 6, wherein:

the detergent suctioner comes in contact with the detergent compartment valve and presses the detergent compartment valve to control an inflow of the detergent into the detergent pump;

the detergent compartment valve includes a guide protrusion protruding to pass through a center of the valve case;

the valve case includes an anti-rotation rib extending forward from a side thereof to prevent the valve case from rotating; and the detergent container includes an anti-rotation flange defined adjacent to one side of the anti-rotation rib to prevent a rotation of the anti-rotation rib.

16. A detergent supply device comprising:

a detergent container having a detergent accommodation space and a plurality of detergent container holes therein; and a detergent pump detachably coupled to the detergent container, the detergent pump to pump a detergent accommodated in the detergent accommodation space, the detergent pump including:

a plurality of electrodes to detect an amount of the detergent accommodated in the detergent accommodation space, the plurality of electrodes extending forward to be inserted into the detergent accommodation space, wherein in response to coupling the detergent pump to the detergent container, the plurality of electrodes passes through the plurality of detergent container holes, respectively, and is accommodated in the detergent accommodation space.

17. The detergent supply device of claim 16, wherein the detergent pump further includes a detergent suctioner to suction the detergent accommodated in the detergent accommodation space into the detergent pump, the detergent suctioner extends forward and to be inserted into the detergent accommodation space.

18. The detergent supply device of claim 17, wherein the plurality of detergent container holes includes:

a first detergent container hole formed in a rear side of the detergent container and corresponding to the detergent suctioner so that the detergent suctioner passes through the first detergent container hole and is accommodated in the detergent accommodation space; and the plurality of detergent container holes in which the plurality of electrodes passes through, is a second detergent container holes in the rear side of the detergent container, apart from the first detergent container hole, and corresponds to the plurality of the electrodes so that the plurality of electrodes passes through the second detergent container holes, respectively, and are accommodated in the detergent accommodation space.

* * * * *